US011686065B2

(12) United States Patent
Izumikawa et al.

(10) Patent No.: US 11,686,065 B2
(45) Date of Patent: Jun. 27, 2023

(54) SHOVEL

(71) Applicant: SUMITOMO CONSTRUCTION MACHINERY CO., LTD., Tokyo (JP)

(72) Inventors: Takeya Izumikawa, Chiba (JP); Hiroyuki Tsukamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 366 days.

(21) Appl. No.: 16/892,667

(22) Filed: Jun. 4, 2020

(65) Prior Publication Data

US 2020/0291606 A1 Sep. 17, 2020

Related U.S. Application Data

(63) Continuation of application No. PCT/JP2018/045181, filed on Dec. 7, 2018.

(30) Foreign Application Priority Data

Dec. 7, 2017 (JP) ..... 2017-235556

(51) Int. Cl.

| | |
|---|---|
| ***E02F 9/12*** | (2006.01) |
| ***E02F 3/32*** | (2006.01) |
| ***E02F 3/36*** | (2006.01) |
| ***E02F 9/20*** | (2006.01) |
| ***E02F 9/26*** | (2006.01) |

(52) U.S. Cl.

CPC ..... *E02F 9/123* (2013.01); *E02F 3/32* (2013.01); *E02F 3/36* (2013.01); *E02F 9/2004* (2013.01); *E02F 9/261* (2013.01)

(58) Field of Classification Search

CPC ..... E02F 3/32; E02F 3/36; E02F 9/123; E02F 9/2004; E02F 9/2033; E02F 9/261; E02F 9/262; E02F 9/265

See application file for complete search history.

(56) References Cited

U.S. PATENT DOCUMENTS

| | | | | |
|---|---|---|---|---|
| 6,076,029 | A | 6/2000 | Watanabe et al. | |
| 6,158,539 | A * | 12/2000 | Isley | B62D 55/116 280/6.154 |
| 9,624,648 | B2 | 4/2017 | Arimatsu et al. | |
| 9,828,747 | B2 | 11/2017 | Arimatsu et al. | |
| 10,161,111 | B2 * | 12/2018 | Iwanaga | E02F 9/261 |

(Continued)

FOREIGN PATENT DOCUMENTS

| | | |
|---|---|---|
| JP | S54-024499 | 2/1979 |
| JP | H05-059745 | 3/1993 |

(Continued)

OTHER PUBLICATIONS

International Search Report for PCT/JP2018/045181 dated Feb. 5, 2019.

*Primary Examiner* — Tyler J Lee

(74) *Attorney, Agent, or Firm* — IPUSA, PLLC

(57) ABSTRACT

A shovel includes a lower traveling body, an upper swiveling body that is rotatably mounted on the lower traveling body, and a controller configured to perform straight facing control by which an actuator is operated to cause the upper swiveling body to face a target construction surface straight, based on information related to the target construction surface and information related to a direction of the upper swiveling body.

11 Claims, 15 Drawing Sheets

(56) References Cited

U.S. PATENT DOCUMENTS

| | | | | |
|---|---|---|---|---|
| 2011/0311342 | A1* | 12/2011 | Montgomery | E02F 9/264 414/685 |
| 2013/0158797 | A1* | 6/2013 | Fukano | E02F 9/264 701/36 |
| 2014/0100712 | A1 | 4/2014 | Nomura et al. | |
| 2015/0120143 | A1* | 4/2015 | Schlichting | B62D 13/06 701/1 |
| 2016/0237654 | A1 | 8/2016 | Arimatsu et al. | |
| 2016/0251834 | A1* | 9/2016 | Arimatsu | E02F 9/26 414/687 |
| 2017/0175362 | A1* | 6/2017 | Iwanaga | G01S 19/43 |
| 2018/0167588 | A1 | 6/2018 | Izumikawa et al. | |

FOREIGN PATENT DOCUMENTS

| | | |
|---|---|---|
| JP | H05-112977 | 5/1993 |
| JP | H07-288753 | 10/1995 |
| JP | H09-256407 | 9/1997 |
| JP | 2006-144349 | 6/2006 |
| JP | 2008-106440 | 5/2008 |
| JP | 2008-179940 | 8/2008 |
| JP | 2013-217137 | 10/2013 |
| JP | 5826397 | 12/2015 |
| JP | 5886962 | 3/2016 |
| KR | 2015-0142031 | 12/2015 |
| WO | 2017/026469 | 2/2017 |

* cited by examiner

SHOVEL

CROSS-REFERENCE TO RELATED APPLICATION

This application is a continuation application of International Application No. PCT/JP2018/045181 filed on Dec. 7, 2018, and designated the U.S., which is based upon and claims priority to Japanese Patent Application No. 2017-235556, filed on Dec. 7, 2017, the entire contents of which are incorporated herein by reference.

BACKGROUND OF THE INVENTION

1. Field of the Invention

The present disclosure relates to a shovel.

2. Description of the Related Art

A shovel that enables an operator to recognize whether a shovel faces a target construction surface, such as a slope, straight, has been known. The shovel displays an image representing an extending direction of the target construction surface or a direction perpendicular to the extending direction of the target construction surface, superimposed on a camera image, so as to enable the operator to recognize whether the shovel faces the target construction surface straight. The camera image is an overhead image generated by combining images obtained by multiple cameras mounted to the shovel.

SUMMARY

According to one aspect of an embodiment, a shovel includes a lower traveling body, an upper swiveling body that is rotatably mounted on the lower traveling body, and a controller configured to perform straight facing control by which an actuator is operated to cause the upper swiveling body to face a target construction surface straight, based on information related to the target construction surface and information related to a direction of the upper swiveling body.

DETAILED DESCRIPTION

The above-described shovel only enables the operator to recognize whether the shovel faces the target construction surface straight. Thus, when the shovel does not face the target construction surface straight, the operator who wants the shovel to face the target construction surface straight needs to perform a swiveling operation. In this point, the above-described shovel might annoy the operator.

Therefore, it is desired to provide a shovel that can reduce annoyance at causing the shovel to face the target construction surface straight.

Figure 1:
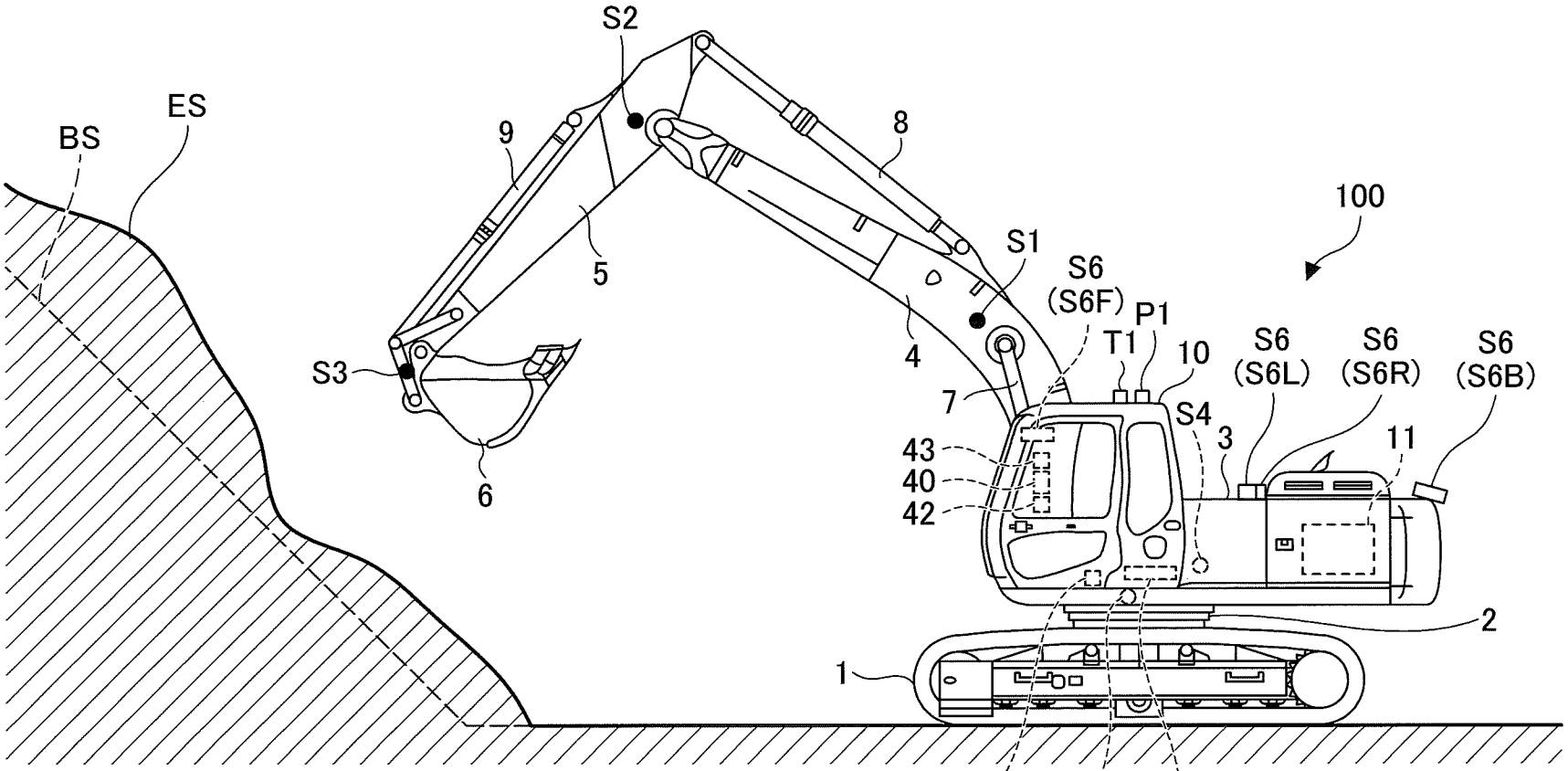
FIG. 1 is a side view of a shovel according to an embodiment of the present invention.

FIG. 1 is a side view of a shovel 100 as an excavator according to an embodiment of the present invention. An upper swiveling body 3 is rotatably mounted on a lower traveling body 1 of the shovel 100 through a swiveling mechanism 2. A boom 4 is attached to the upper swiveling body 3. An arm 5 is attached to a front end of the boom 4, and a bucket 6 as an end attachment is attached to a front end of the arm 5.

The boom 4, the arm 5, and the bucket 6 form an excavation attachment as an example of the attachment. The boom 4 is driven by a boom cylinder 7, the arm 5 is driven by an arm cylinder 8, and the bucket 6 is driven by a bucket cylinder 9. A boom angle sensor S1 is mounted to the boom 4, an arm angle sensor S2 is mounted to the arm 5, and a bucket angle sensor S3 is mounted to the bucket 6.

The boom angle sensor S1 is configured to detect the rotation angle of the boom 4. In the present embodiment, the boom angle sensor S1 is an acceleration sensor, and the rotation angle of the boom 4 with respect to the upper swiveling body 3 (which will be hereinafter referred to as the "boom angle") can be detected. The boom angle is, for example, the minimum angle when the boom 4 is moved down at a lowest position and the boom angle increases as the boom 4 is raised.

The arm angle sensor S2 is configured to detect the rotation angle of the arm 5. In the present embodiment, the arm angle sensor S2 is an acceleration sensor, and the rotation angle of the arm 5 with respect to the boom 4 (which will be hereinafter referred to as the "arm angle") can be detected. The arm angle is, for example, the minimum angle when the arm 5 is closed at most and the arm angle increases as the arm 5 is opened.

The bucket angle sensor S3 is configured to detect the rotation angle of the bucket 6. In the present embodiment, the bucket angle sensor S3 is an acceleration sensor, and the rotation angle of the bucket 6 with respect to the arm 5 (which will be hereinafter referred to as the "bucket angle") can be detected. The bucket angle is, for example, the minimum angle when the bucket 6 is closed at most and increases as the bucket 6 is opened.

The boom angle sensor S1, the arm angle sensor S2, and the bucket angle sensor S3 each may be a potentiometer using a variable resistor, a stroke sensor that detects a stroke amount of a corresponding hydraulic cylinder, a rotary encoder that detects the rotation angle around a coupling pin, a gyro sensor, or a combination of an acceleration sensor and a gyro sensor.

A cab 10, which is an operation room, is provided in the upper swiveling body 3 and a power source such as an engine 11 is mounted to the upper swiveling body 3. A controller 30, a display device 40, an input device 42, a sound output device 43, a storage device 47, a machine body tilt sensor S4, a swivel angular velocity sensor S5, a camera S6, a communication device T1, and a positioning device P1 are mounted to the upper swiveling body 3.

The controller 30 is configured to function as a main controller for drive control of the shovel 100. In the present embodiment, the controller 30 is formed by a computer including a CPU, a RAM, and a ROM. Various functions of the controller 30 are achieved by, for example, the CPU executing a program stored in the ROM. The various functions include, for example, a machine guidance function that guides an operator to perform a manual operation of the shovel 100 and a machine control function that automatically assists the operator to perform the manual operation of the shovel 100. A machine guidance device 50 included in the controller 30 is configured to perform the machine guidance function and the machine control function.

The display device 40 is configured to display various information. The display device 40 may be connected to the controller 30 through a communication network such as CAN or may be connected to the controller 30 through a private network.

The input device 42 is configured to enable an operator to input various information to the controller 30. The input device 42 includes a touch panel, a knob switch, and a membrane switch that are mounted in the cab 10.

The sound output device 43 is configured to output a sound. The sound output device 43 may be, for example, an on-board speaker connected to the controller 30 or an alarm such as a buzzer. According to the present embodiment, the sound output device 43 is configured to output the sound indicating various information in response to a sound output command from the controller 30.

The storage device 47 is configured to store various information. The storage device 47 is, for example, a non-volatile storage medium, such as a semiconductor memory. The storage device 47 may store information output by the various devices during operation of the shovel 100 and may store information obtained through the various devices before the operation of the shovel 100 is started. For example, the storage device 47 may store information related to the target construction surface obtained through the communication device T1 or the like. The target construction surface may be set by the operator of the shovel 100, a construction manager, or the like.

The machine body tilt sensor S4 is configured to detect the tilt of the upper swiveling body 3 with respect to a virtual horizontal plane. In the present embodiment, the machine body tilt sensor S4 is an acceleration sensor that detects the tilt angle around the front and rear axis of the upper swiveling body 3 and the tilt angle around the left and right axis of the upper swiveling body 3. The front and rear axis and the left and right axis of the upper swiveling body 3 are orthogonal to each other at the center point of the shovel, which is a point on the swiveling axis of the shovel 100, for example.

The swivel angular velocity sensor S5 is configured to detect the swivel angular velocity of the upper swiveling body 3. The swivel angular velocity sensor 55 may be configured to detect or calculate the rotation angle of the upper swiveling body 3. In the present embodiment, the swivel angular velocity sensor S5 is a gyro sensor. The swivel angular velocity sensor S5 may be a resolver, a rotary encoder, or the like.

The camera S6 is an example of a spatial recognition device and is configured to obtain an image around the shovel 100. In the present embodiment, the camera S6 includes a front camera S6F that images a space in front of the shovel 100, a left camera S6L that images a space on the left of the shovel 100, a right camera S6R that images a space on the right of the shovel 100, and a rear camera S6B that images a space at the rear of the shovel 100.

The camera S6 is, for example, a monocular camera having an imaging element such as a CCD or CMOS, and outputs a taken image to the display device 40. The camera S6 may be a stereo camera, a distance image camera, or the like. The camera S6 may be replaced by another spatial recognition device, such as an ultrasonic sensor, a millimeter wave radar, a LIDAR sensor, or an infrared sensor, and may be replaced by a combination of another spatial recognition device and a camera.

The front camera S6F is mounted to, for example, a ceiling of the cab 10, that is, inside the cab 10. However, the front camera S6F may be mounted to a roof of the cab 10, that is, outside the cab 10. The left camera S6L is mounted to a left end of the upper surface of the upper swiveling body 3, the right camera S6R is mounted to a right end of the upper surface of the upper swiveling body 3, and the rear camera S6B is mounted to a rear end of the upper surface of the upper swiveling body 3.

The communication device T1 controls communication with an external device outside the shovel 100. In the present embodiment, the communication device T1 controls communication with an external device through a satellite communication network, a cellular phone communication network, the Internet, or the like. The external device may be, for example, a management device such as a server installed in an external facility or an assistant device such as a smartphone carried by a worker around the shovel 100. The external device, for example, is configured to manage construction information about one or more shovels 100. The construction information includes, for example, information related to at least one of operation time, fuel consumption, and a workload of the shovel 100. The workload is, for example, the amount of excavated earth and sand and the amount of earth and sand loaded onto a dump truck platform. The shovel 100 is configured to send the construction information related to the shovel 100 to the external device through the communication device T1 at a predetermined time interval.

The positioning device P1 is configured to measure the position of the upper swiveling body 3. The positioning device P1 may be configured to measure a direction of the upper swiveling body 3. In the present embodiment, the positioning device P1 is, for example, a GNSS compass. The positioning device P1 detects the position and direction of the upper swiveling body 3 and outputs a detected value to the controller 30. Therefore, the positioning device P1 can function as a direction detecting device that detects the direction of the upper swiveling body 3. The direction detecting device may be a direction sensor mounted to the upper swiveling body 3.

Figure 2:
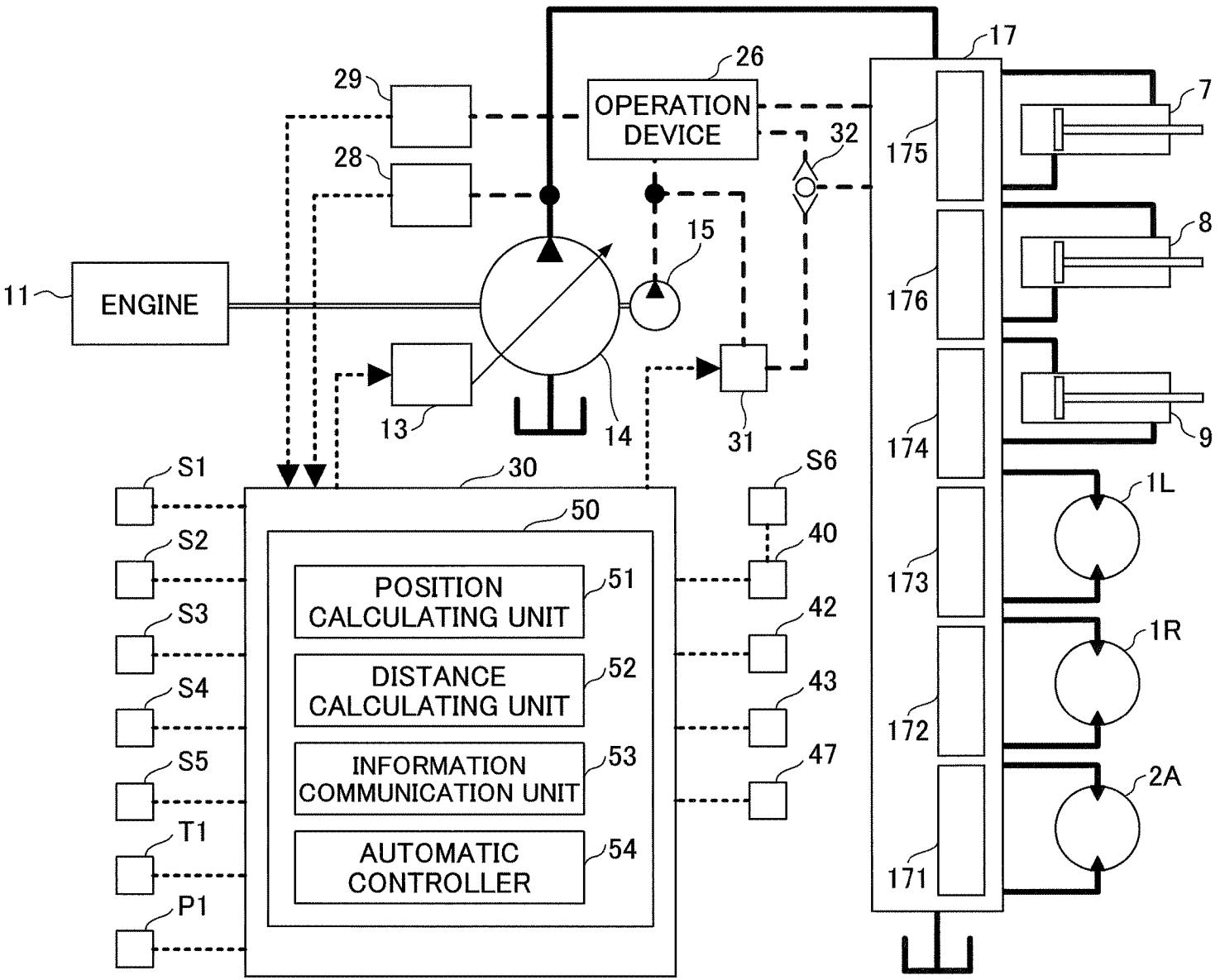
FIG. 2 is a block diagram illustrating a configuration example of a driving system of the shovel of FIG. 1.

FIG. 2 is a block diagram illustrating a configuration example of a driving system of the shovel 100, and a mechanical power system, a hydraulic oil line, a pilot line, and an electric control system are illustrated with double lines, a solid line, a dashed line, and a dotted line, respectively.

The driving system of the shovel 100 mainly includes the engine 11, a regulator 13, a main pump 14, a pilot pump 15, a control valve 17, an operation device 26, a discharge pressure sensor 28, an operation pressure sensor 29, the controller 30, and a proportional valve 31.

The engine 11 is a driving source of the shovel 100. In the present embodiment, the engine 11 is, for example, a diesel engine that is operated to maintain a predetermined rotation speed. Output shafts of the engine 11 are coupled to respective input shafts of the main pump 14 and pilot pump 15.

The main pump 14 is configured to supply hydraulic oil to the control valve 17 through the hydraulic oil line. In the present embodiment, the main pump 14 is a swash plate variable displacement hydraulic pump.

The regulator 13 is configured to control the discharge amount of the main pump 14. In the present embodiment, the regulator 13 controls the discharge amount of the main pump 14 by adjusting the swash plate tilt angle of the main pump 14 in response to a control command from the controller 30. For example, the controller 30 receives an output of the operation pressure sensor 29 for example, and outputs a control command to the regulator 13 as needed to change the discharge amount of the main pump 14.

The pilot pump 15 supplies the hydraulic oil through the pilot line to various hydraulic control devices, including the operation device 26 and the proportional valve 31. In the present embodiment, the pilot pump 15 is a fixed displacement hydraulic pump. However, the pilot pump 15 may be omitted. In this case, the function performed by the pilot pump 15 may be achieved by the main pump 14. That is, the main pump 14 may be provided with a circuit other than a function supplying the hydraulic oil to the control valve 17, and may provide a function supplying the hydraulic oil to the operation device 26 or the like after the supply pressure of the hydraulic oil is lowered by restriction or the like.

The control valve 17 is a hydraulic controller that controls a hydraulic system in the shovel 100. In the present embodiment, the control valve 17 includes control valves 171 to 176. The control valve 17 may selectively supply the hydraulic oil discharged by the main pump 14 to one or more hydraulic actuators through the control valves 171 to 176. The control valves 171 to 176 are configured to control the flow rate of the hydraulic oil flowing from the main pump 14 to the hydraulic actuator and the flow rate of the hydraulic oil flowing from the hydraulic actuator to a hydraulic oil tank. The hydraulic actuator includes the boom cylinder 7, the arm cylinder 8, the bucket cylinder 9, a left-side traveling hydraulic motor 1L, a right-side traveling hydraulic motor 1R, and a swiveling hydraulic motor 2A. The swiveling hydraulic motor 2A may be a swiveling motor generator as an electric actuator.

The operation device 26 is a device used by an operator for operating the actuator. The actuator includes at least either the hydraulic actuator or the electric actuator. In the present embodiment, the operation device 26 supplies the hydraulic oil discharged by the pilot pump 15 through a pilot line to the pilot port of the corresponding control valve in the control valve 17. The pressure of the hydraulic oil supplied to each of the pilot ports (i.e., the pilot pressure) is basically a pressure in accordance with the direction and amount of the operation of the operation device 26 corresponding to each of the hydraulic actuators. At least one of the operation devices 26 is configured to supply the hydraulic oil discharged by the pilot pump 15 to the pilot port of a corresponding control valve in the control valve 17 through the pilot line and a shuttle valve 32.

The discharge pressure sensor 28 is configured to detect the discharge pressure of the main pump 14. In the present embodiment, the discharge pressure sensor 28 outputs a detected value to the controller 30.

The operation pressure sensor 29 is configured to detect an operation content of the operator using the operation device 26. In the present embodiment, the operation pressure sensor 29 detects the direction and amount of the operation of the operation device 26 corresponding to each of the actuators in the form of the pressure, and outputs a detected value to the controller 30. The operation content of the operation device 26 may be detected using a sensor other than the operation pressure sensor.

The proportional valve 31, which functions as a machine control valve, is disposed in a conduit connecting the pilot pump 15 and the shuttle valve 32 and is configured to change the flow area of the conduit. In the present embodiment, the proportional valve 31 operates in response to a control command output by the controller 30. Thus, the controller 30 can supply the hydraulic oil discharged by the pilot pump 15 to the pilot port of the corresponding control valve in the control valve 17 through the proportional valve 31 and the shuttle valve 32, independently of the operation of the operation device 26 by the operator.

The shuttle valve 32 includes two inlet ports and one outlet port. One of the two inlet ports is connected to the operation device 26 and the other is connected to the proportional valve 31. The outlet port is connected to a pilot port of a corresponding control valve in the control valve 17. Thus, the shuttle valve 32 can apply higher one of either the pilot pressure generated by the operation device 26 or the pilot pressure generated by the proportional valve 31 to the corresponding pilot port of the control valve.

With this configuration, the controller 30 can operate the hydraulic actuator corresponding to the specific operation device 26 even when no operation is performed on the specific operation device 26.

Next, the machine guidance device 50 included in the controller 30 will be described. The machine guidance device 50 is configured to perform, for example, a machine guidance function. In the present embodiment, the machine guidance device 50 communicates work information to the operator, such as the distance between the target construction surface and a working part of the attachment. Information related to the target construction surface is stored in the storage device 47 in advance, for example. The machine guidance device 50 may obtain the information related to the target construction surface from the external device through the communication device T1. The information related to the target construction surface is represented in a frame of reference, for example. The frame of reference is, for example, the World Geodetic System. The World Geodetic System is a three-dimensional orthogonal XYZ coordinate system in which the origin is located at the Earth's center of mass, the X-axis is in the direction toward the intersection of the Greenwich meridian and the equator, the Y-axis is in the direction of 90 degrees east longitude, and the Z-axis is in the direction toward the Arctic. The target construction surface may be set based on a relative positional relationship to a reference point. In this case, the operator may define any given point of the construction site as the reference point. The working part of the attachment is, for example, the toe of the bucket 6 or the back of the bucket 6. The machine guidance device 50 may be configured to guide the operation of the shovel 100 by communicating operational information to the operator through the display device 40 or the sound output device 43, for example.

The machine guidance device 50 may perform a machine control function that automatically assists the manual operation of the shovel 100 performed by the operator. For example, the machine guidance device 50 may automatically operate at least one of the boom 4, the arm 5 and the bucket 6, so that the target construction surface coincides with the position of the tip of the bucket 6 when the operator manually performs an excavating operation.

In the present embodiment, the machine guidance device 50 is incorporated into the controller 30, but may be a controller separately provided from the controller 30. In this case, the machine guidance device 50, for example, is formed by a computer including, a CPU and an internal memory, in a manner similar to the controller 30. The various functions of the machine guidance device 50 are achieved by the CPU executing a program stored in the internal memory. The machine guidance device 50 and the controller 30 are communicably connected to each other through a communication network such as CAN.

Specifically, the machine guidance device 50 obtains information from the boom angle sensor S1, the arm angle sensor S2, the bucket angle sensor S3, the machine body tilt sensor S4, the swivel angular velocity sensor S5, the camera S6, the positioning device P1, the communication device T1, and the input device 42, for example. The machine guidance device 50, for example, calculates the distance between the bucket 6 and the target construction surface based on the obtained information and communicates the distance between the bucket 6 and the target construction surface to the operator of the shovel 100 by at least either sound or image display.

Therefore, the machine guidance device 50 includes a position calculating unit 51, a distance calculating unit 52, an information communication unit 53, and an automatic controller 54.

The position calculating unit 51 is configured to calculate a position of a positioning object. In the present embodiment, the position calculating unit 51 calculates a coordinate point in the reference frame of the working part of the attachment. Specifically, the position calculating unit 51 calculates the coordinate point of the toe of the bucket 6 from the respective rotation angles of the boom 4, the arm 5, and the bucket 6. The position calculating unit 51 may calculate not only the coordinate point of the center of the toe of the bucket 6 but also the coordinate point of the left end of the toe of the bucket 6 and the coordinate point of the right end of the toe of the bucket 6.

The distance calculating unit 52 is configured to calculate the distance between two positioning objects. In the present embodiment, the distance calculating unit 52 calculates the vertical distance between the toe of the bucket 6 and the target construction surface. The distance calculating unit 52 may calculate distances between the respective coordinate points of the left end and right end of the toe of the bucket 6 and the target construction surface (for example, the vertical distances) so that the machine guidance device 50 can determine whether the shovel 100 faces the target construction surface straight.

The information communication unit 53 is configured to communicate various information to the operator of the shovel 100. In the present embodiment, the information communication unit 53 communicates various distances calculated by the distance calculating unit 52 to the operator of the shovel 100. Specifically, the vertical distance between the toe of the bucket 6 and the target construction surface is communicated to the operator of the shovel 100 using at least either visual information or audio information.

For example, the information communication unit 53 may communicate the vertical distance between the toe of the bucket 6 and the target construction surface to the operator using an intermittent sound generated by the sound output device 43. In this case, the information communication unit 53 may shorten an interval of the intermittent sound as the vertical distance decreases. The information communication unit 53 may use a continuous sound and may change at least one of a pitch of the sound, strength of the sound, and the like to indicate a difference in the vertical distance. The information communication unit 53 may issue an alarm when the toe of the bucket 6 is lower than the target construction surface. The alarm is, for example, a continuous sound that is significantly greater than the intermittent sound.

The information communication unit 53 may display the vertical distance between the toe of the bucket 6 and the target construction surface as the work information on the display device 40. The display device 40 displays, for example, the work information received from the information communication unit 53 with image data received from the camera S6, on the screen. The information communication unit 53 may communicate the vertical distance to the operator using an image of an analog meter or an image of a bar graph indicator, for example.

The automatic controller 54 automatically operates the actuator to automatically assist the manual operation of the shovel 100 performed by the operator. For example, the automatic controller 54 may automatically extend and retract at least one of the boom cylinder 7, the arm cylinder 8, and the bucket cylinder 9 so that the target construction surface coincides with the position of the toe of the bucket 6 when the operator manually performs a closing operation of the arm. In this case, the operator can close the arm 5 with the toe of the bucket 6 coinciding with the target construction surface by simply operating an arm operation lever in a closing direction, for example. The automatic control may be configured to be performed when a predetermined switch, which is one of the input devices 42, is pressed. The predetermined switch is, for example, a machine control switch (which will be hereinafter referred to as the "MC switch"), and may be disposed as a knob switch at an end of the operation device 26.

The automatic controller 54 may automatically rotate the swiveling hydraulic motor 2A in order to cause the upper swiveling body 3 to face the target construction surface straight when the predetermined switch, such as the MC switch, is pressed. In this case, the operator can cause the upper swiveling body 3 to face the target construction surface straight by simply pressing the predetermined switch or operating a swiveling operation lever while pressing the predetermined switch. Alternatively, the operator can cause the upper swiveling body 3 to face the target construction surface straight and start the machine control function by simply pressing the predetermined switch. In the following, the control of causing the upper swiveling body 3 to face the target construction surface straight is referred to as the "straight facing control". In the straight facing control, the machine guidance device 50 determines that the shovel 100 faces the target construction surface straight when the vertical distance at the left end, which is the vertical distance between the coordinate point at the left end of the toe of the bucket 6 and the target construction surface, is equal to the vertical distance at the right end, which is the vertical distance between the coordinate point at the right end of the toe of the bucket 6 and the target construction surface. However, the machine guidance device 50 may determine that the shovel 100 faces the target construction surface straight when the difference between the vertical distance at the left end and the vertical distance at the right end is smaller than or equal to a predetermined value, which is not when the vertical distance at the left end is equal to the vertical distance at the right end, that is not when the difference between the vertical distance at the left end and the vertical distance at the right end is zero. The machine guidance device 50 may inform the operator that the straight facing control has been completed, using at least either the visual information or the audio information when the machine guidance device 50 determines that the shovel 100 faces the target construction surface straight after automatically rotating the swiveling hydraulic motor 2A. That is, the machine guidance device 50 may inform the operator that the upper swiveling body 3 faces the target construction surface straight.

In the present embodiment, the automatic controller 54 can automatically operate each actuator by individually and automatically adjusting the pilot pressure applied to the control valve corresponding to each actuator. For example, in the straight facing control, the automatic controller 54 may operate the swiveling hydraulic motor 2A based on the difference between the vertical distance at the left end and the vertical distance at the right end. Specifically, when the swiveling operation lever is operated while the predetermined switch is pressed, the automatic controller 54 determines whether the swiveling operation lever is operated in a direction in which the upper swiveling body 3 faces the target construction surface straight. For example, when the swiveling operation lever is operated in a direction in which the vertical distance between the toe of the bucket 6 and the target construction surface (i.e., the backslope) is increased, the automatic controller 54 does not perform the straight facing control. With respect to the above, when the swiveling operation lever is operated in a direction in which the vertical distance between the toe of the bucket 6 and the target construction surface (i.e., the backslope) is reduced, the automatic controller 54 performs the straight facing control. As a result, the automatic controller 54 can operate the swiveling hydraulic motor 2A so that the difference between the vertical distance at the left end and vertical distance at the right end becomes small. Thereafter, the automatic controller 54 stops the swiveling hydraulic motor 2A when the difference is smaller than or equal to the predetermined value, or is zero. Alternatively, the automatic controller 54 may set the rotation angle at which the difference is smaller than or equal to the predetermined value or is zero as a target angle, and perform rotation angle control so that a difference of the angle between the target angle and the present rotation angle (the detected value) becomes zero. In this case, the rotation angle is, for example, the angle of a front and rear axis of the upper swiveling body 3 with respect to the reference direction.

When an operation with respect to the target construction surface, such as an excavating operation or a slope finishing operation, is performed, the automatic controller 54 may automatically operate the actuator so that the upper swiveling body 3 maintains to face the target construction surface straight. For example, when the direction of the upper swiveling body 3 is changed due to excavation reaction forces or the like and the upper swiveling body 3 does not face the target construction surface straight, the automatic controller 54 may automatically operate the swiveling hydraulic motor 2A to cause the upper swiveling body 3 to immediately face the target construction surface straight. Alternatively, when the operation with respect to the target construction surface is being performed, the automatic controller 54 may proactively operate the actuator to prevent the direction of the upper swiveling body 3 from being changed due to excavation reaction forces or the like.

Figure 3:
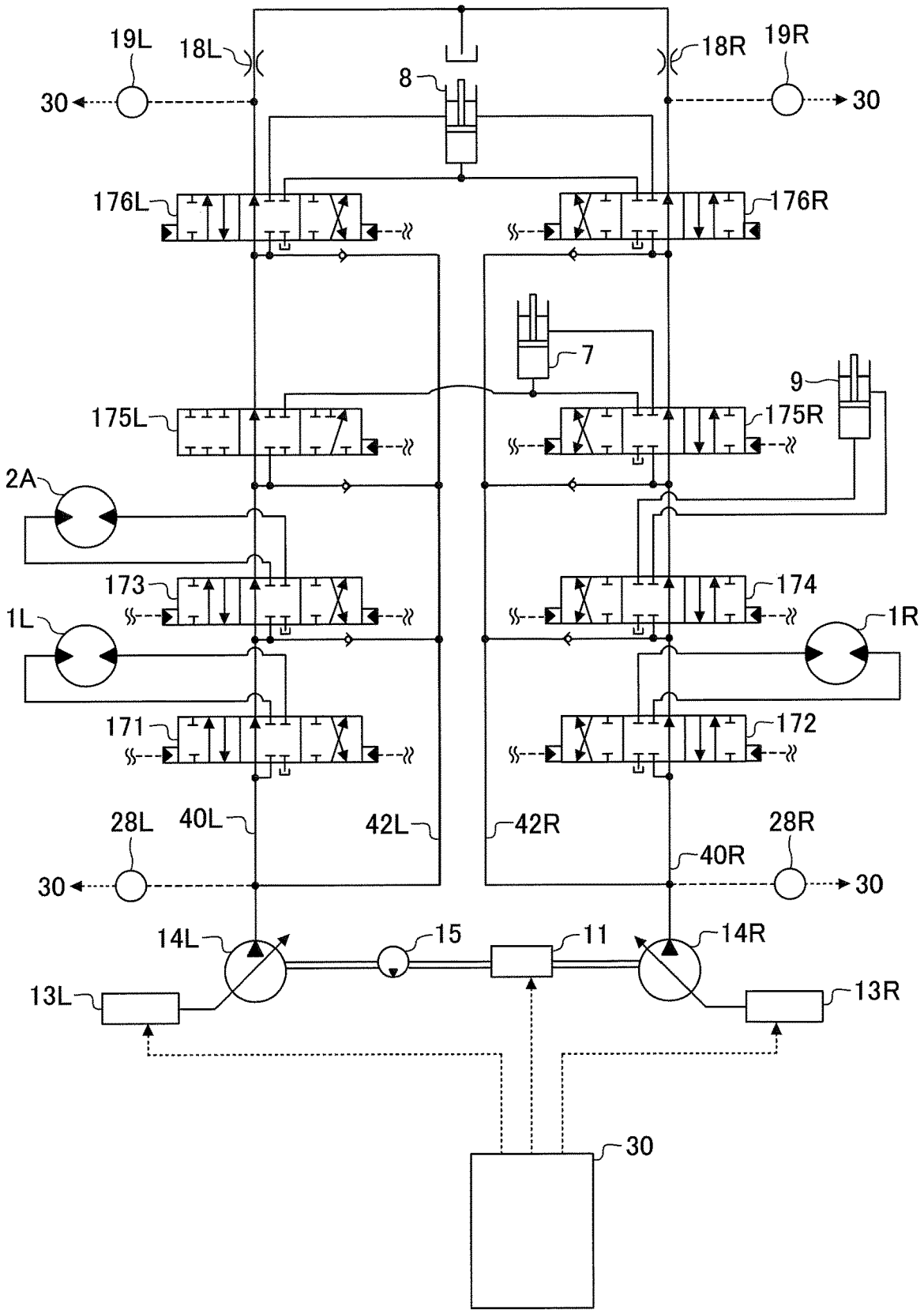
FIG. 3 is a schematic diagram illustrating a configuration example of a hydraulic system mounted to the shovel of FIG. 1.

Next, a configuration example of the hydraulic system mounted to the shovel 100 will be described with reference to FIG. 3. FIG. 3 is a schematic diagram illustrating the configuration example of the hydraulic system mounted to the shovel 100 of FIG. 1. As in FIG. 2, FIG. 3 illustrates the mechanical power system, the hydraulic oil line, the pilot line, and the electric control system with double lines, a solid line, a dashed line, and a dotted line, respectively.

The hydraulic system circulates the hydraulic oil from main pumps 14L and 14R driven by the engine 11 to the hydraulic oil tank through at least one of center bypass conduits 40L and 40R, and parallel conduits 42L and 42R. The main pumps 14L and 14R correspond to the main pump 14 of FIG. 2.

The center bypass conduit 40L is a hydraulic oil line passing through control valves 171, 173, 175L, and 176L disposed in the control valve 17. The center bypass conduit 40R is a hydraulic oil line passing through control valves 172, 174, 175R, and 176R disposed in the control valve 17. The control valves 175L and 175R correspond to the control valve 175 of FIG. 2. The control valves 176L and 176R correspond to the control valve 176 of FIG. 2.

The control valve 171 is a spool valve that supplies the hydraulic oil discharged by the main pump 14L to the left-side traveling hydraulic motor 1L and switches the flow of the hydraulic oil in order to discharge the hydraulic oil discharged by the left-side traveling hydraulic motor 1L to the hydraulic oil tank.

The control valve 172 is a spool valve that supplies the hydraulic oil discharged by the main pump 14R to the right-hand traveling hydraulic motor 1R and switches the flow of the hydraulic oil in order to discharge the hydraulic oil discharged by the right-hand traveling hydraulic motor 1R to the hydraulic oil tank.

The control valve 173 is a spool valve that supplies the hydraulic oil discharged by the main pump 14L to the swiveling hydraulic motor 2A and switches the flow of hydraulic oil in order to discharge the hydraulic oil discharged by the swiveling hydraulic motor 2A to the hydraulic oil tank.

The control valve 174 is a spool valve that supplies the hydraulic oil discharged by the main pump 14R to the bucket cylinder 9 and switches the flow of the hydraulic oil in order to discharge the hydraulic oil in the bucket cylinder 9 to the hydraulic oil tank.

The control valves 175L and 175R are spool valves that supply the hydraulic oil discharged by the main pumps 14L and 14R to the boom cylinder 7 and switch the flow of the hydraulic oil in order to discharge the hydraulic oil in the boom cylinder 7 to the hydraulic oil tank.

The control valves 176L and 176R are spool valves that supply the hydraulic oil discharged by the main pumps 14L and 14R to the arm cylinder 8 and switch the flow of the hydraulic oil in order to discharge the hydraulic oil in the arm cylinder 8 to the hydraulic oil tank.

The parallel conduit 42L is a hydraulic oil line parallel to the center bypass conduit 40L. The parallel conduit 42L is configured to supply hydraulic oil to a downstream control valve when the flow of hydraulic oil passing through the center bypass conduit 40L is restricted or blocked by either of the control valves 171, 173, and 175L. The parallel conduit 42R is a hydraulic oil line parallel to the center bypass conduit 40R. The parallel conduit 42R is configured to supply the hydraulic oil to a downstream control valve when the flow of the hydraulic oil passing through the center bypass conduit 40R is restricted or blocked by either of the control valves 172, 174, and 175R.

Regulators 13L and 13R control the discharge amount of the main pumps 14L and 14R by adjusting the swash plate tilt angles of the main pumps 14L and 14R in accordance with the discharge pressures of the main pumps 14L and 14R. The regulators 13L and 13R correspond to the regulator 13 in FIG. 2. The regulator 13L, for example, adjusts the swash plate tilt angle of the main pump 14L in response to an increase in the discharge pressure of the main pump 14L to reduce the discharge amount. The same applies to the regulator 13R. This is to prevent absorption power (i.e., absorption horsepower) of the main pump 14, which is represented as a product of the discharge pressure and the discharge amount, from exceeding output power (i.e., output horsepower) of the engine 11.

A discharge pressure sensor 28L is an example of the discharge pressure sensor 28. The discharge pressure sensor 28L detects the discharge pressure of the main pump 14L, and outputs a detected value to the controller 30. The same applies to a discharge pressure sensor 28R.

Here, a negative control employed in the hydraulic system of FIG. 3 will be described.

In the center bypass conduit 40L, a throttle 18L is arranged between the control valve 176L, which is located most downstream, and the hydraulic oil tank. The flow of the hydraulic oil discharged by the main pump 14L is restricted by the throttle 18L. The throttle 18L generates control pressure for controlling the regulator 13L. A control pressure sensor 19L is a sensor for detecting the control pressure and outputs a detected value to the controller 30. Similarly, in the center bypass conduit 40R, a throttle 18R is arranged between the control valve 176R, which is located most downstream, and the hydraulic oil tank. The flow of the hydraulic oil discharged by the main pump 14R is restricted by the throttle 18R. The throttle 18R generates control pressure for controlling the regulator 13R. A control pressure sensor 19R is a sensor for detecting the control pressure and outputs a detected value to the controller 30.

The controller 30 controls the discharge amount of the main pump 14L by adjusting the swash plate tilt angle of the main pump 14L in accordance with the control pressure detected by the control pressure sensor 19L. The controller 30 decreases the discharge amount of the main pump 14L as the control pressure is increased, and increases the discharge amount of the main pump 14L as the control pressure is decreased.

Specifically, as illustrated in FIG. 3, in a standby state in which none of the hydraulic actuators in the shovel 100 is operated, the hydraulic oil discharged by the main pump 14L reaches the throttle 18L through the center bypass conduit 40L. The flow of the hydraulic oil discharged by the main pump 14L increases the control pressure generated upstream from the throttle 18L. As a result, the controller 30 reduces the discharge amount of the main pump 14L to the allowable minimum discharge amount and suppresses pressure loss (i.e., pumping loss) when the discharged hydraulic oil passes through the center bypass conduit 40L.

When any of the hydraulic actuators is operated, the hydraulic oil discharged by the main pump 14L flows into a hydraulic actuator to be operated through a control valve corresponding to the hydraulic actuator to be operated. The flow of the hydraulic oil discharged by the main pump 14L decreases or removes the amount of the hydraulic oil reaching the throttle 18L, thereby lowering the control pressure generated upstream from the throttle 18L. As a result, the controller 30 increases the discharge amount of the main pump 14L and circulates the sufficient hydraulic oil in the hydraulic actuator to be operated to stably perform the operation of the hydraulic actuator to be operated. The description of the main pump 14L above similarly applies to the main pump 14R as well.

With the configuration described above, the hydraulic system of FIG. 3 can reduce excessive energy consumption in the main pumps 14L and 14R in the standby state. The excessive energy consumption includes the pumping loss generated in the center bypass conduits 40L and 40R by the hydraulic oil discharged by the main pumps 14L and 14R. Additionally, in the hydraulic system of FIG. 3, the necessary and sufficient hydraulic oil can be supplied from the main pumps 14L and 14R to the hydraulic actuator to be operated when the hydraulic actuator is operated.

Figure 4A:
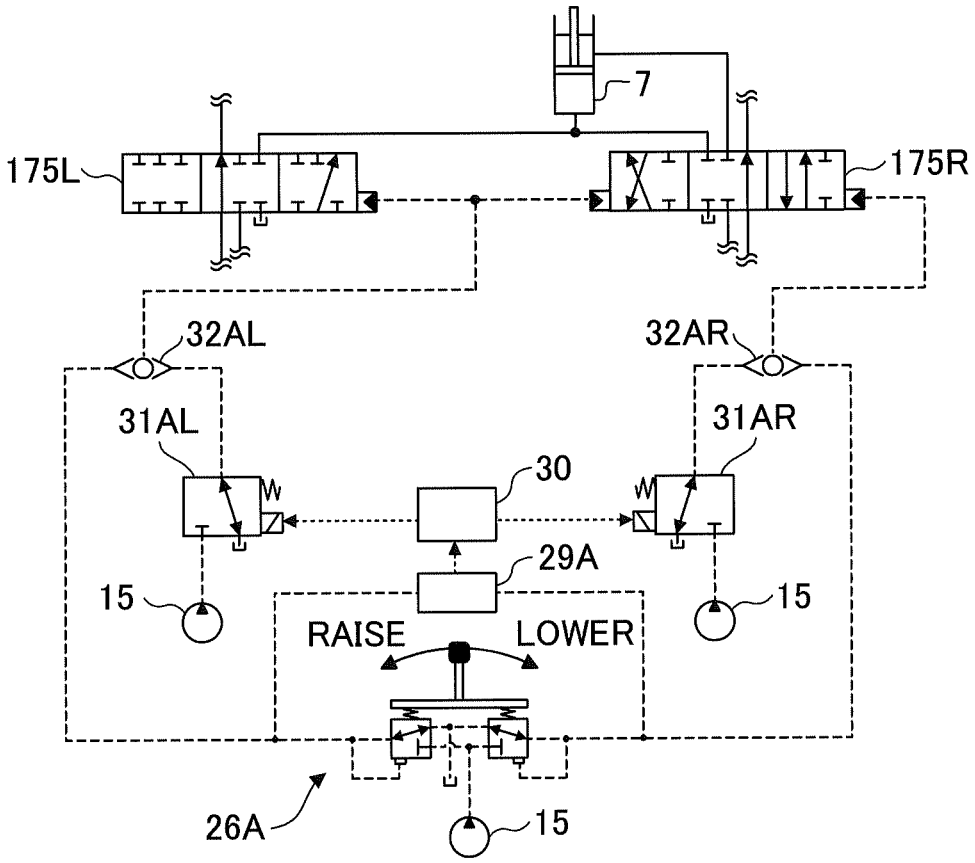
FIG. 4A is a diagram of a part extracted from the hydraulic system mounted to the shovel of FIG. 1.
Figure 4B:
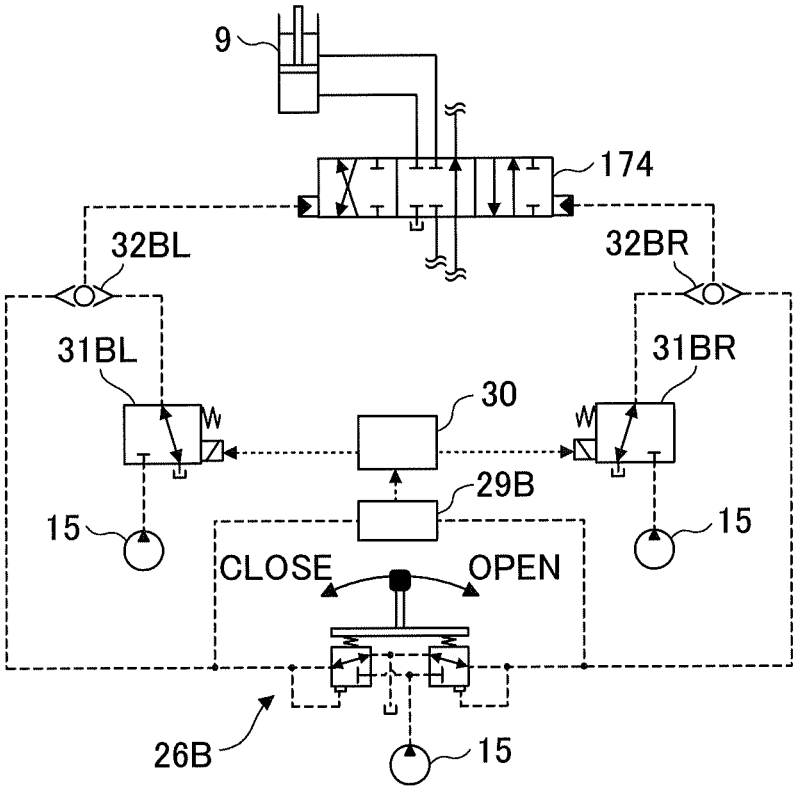
FIG. 4B is a diagram of a part extracted from the hydraulic system mounted to the shovel of FIG. 1.
Figure 4C:
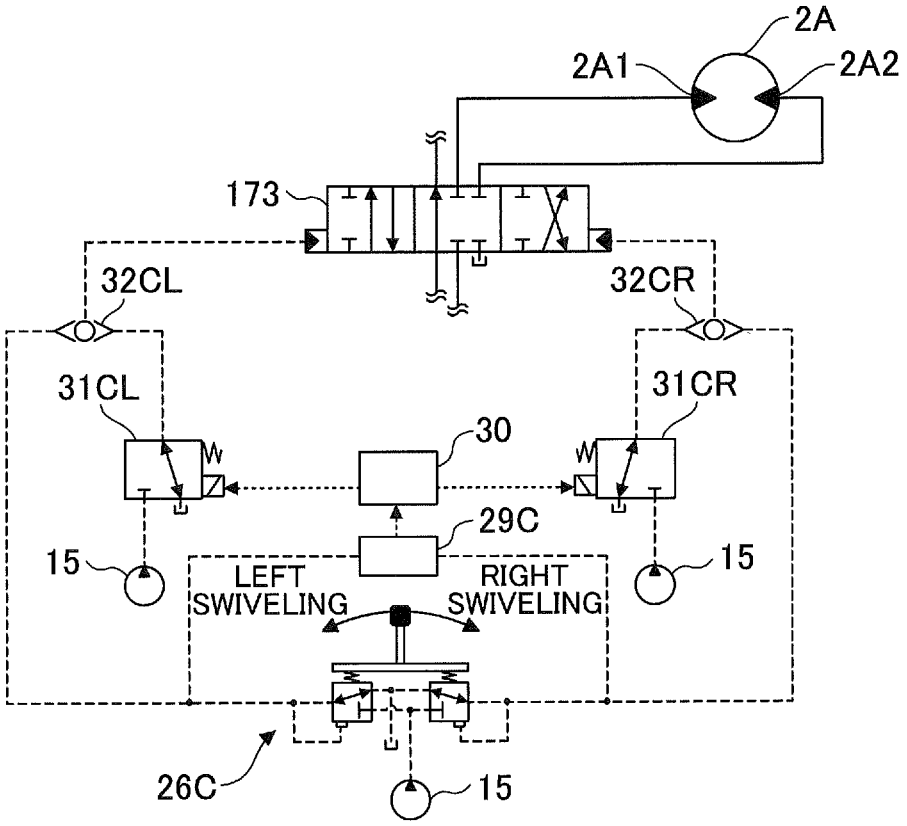
FIG. 4C is a diagram of a part extracted from the hydraulic system mounted to the shovel of FIG. 1.

Next, a configuration for automatically operating the actuator will be described with reference to FIGS. 4A to 4C. FIGS. 4A to 4C are diagrams of parts extracted from the hydraulic system. Specifically, FIG. 4A is a diagram extracting a hydraulic system part related to the operation of the boom cylinder 7, FIG. 4B is a diagram extracting a hydraulic system part related to the operation of the bucket cylinder 9, and FIG. 4C is a diagram extracting a hydraulic system part related to the operation of the swiveling hydraulic motor 2A.

A boom operation lever 26A of FIG. 4A is an example of the operation device 26 and is used to operate the boom 4. The boom operation lever 26A utilizes the hydraulic oil discharged by the pilot pump 15 to apply the pilot pressure corresponding to the operation content to the pilot ports of the control valves 175L and 175R. Specifically, when the boom operation lever 26A is operated in a boom raising direction, the boom operation lever 26A applies the pilot pressure in accordance with the amount of the operation to the right pilot port of the control valve 175L and the left pilot port of the control valve 175R. When the boom operation lever 26A is operated in a boom lowering direction, the boom operation lever 26A applies the pilot pressure in accordance with the amount of the operation to the right pilot port of the control valve 176R.

An operation pressure sensor 29A is an example of the operation pressure sensor 29. The operation pressure sensor 29A detects the operation content of the operator to the boom operation lever 26A in the form of pressure and outputs a detected value to the controller 30. The operation content includes, for example, an operation direction and an operation amount (or an operation angle).

Proportional valves 31AL and 31AR are examples of the proportional valve 31, and shuttle valves 32AL and 32AR are examples of the shuttle valve 32. The proportional valve 31AL operates in response to a current command output by the controller 30. The proportional valve 31AL then adjusts the pilot pressure generated by the hydraulic oil introduced into the right pilot port of the control valve 175L and the left pilot port of the control valve 175R from the pilot pump 15 through the proportional valve 31AL and the shuttle valve 32AL. The proportional valve 31AR operates in response to a current command output by the controller 30. The proportional valve 31AR then adjusts the pilot pressure generated by hydraulic oil introduced into the right pilot port of the control valve 175R from the pilot pump 15 through the proportional valve 31AR and the shuttle valve 32AR. The proportional valves 31AL and 31AR can adjust the pilot pressure so that the control valves 175L and 175R can be stopped at a desired valve position.

With this configuration, the controller 30 can supply the hydraulic oil discharged by the pilot pump 15 to the right pilot port of the control valve 175L and the left pilot port of the control valve 175R through the proportional valve 31AL and the shuttle valve 32AL, independently of the boom raising operation by the operator, for example. That is, the controller 30 can automatically raise the boom 4. The controller 30 can also supply the hydraulic oil discharged by the pilot pump 15 to the right pilot port of the control valve 175R through the proportional valve 31AR and the shuttle valve 32AR, independently of the boom lowering operation by the operator. That is, the controller 30 can automatically lower the boom 4.

A bucket operation lever 26B of FIG. 4B is an example of the operation device 26 and is used to operate the bucket 6. The bucket operation lever 26B utilizes the hydraulic oil discharged by the pilot pump 15 to apply the pilot pressure corresponding to the operation content to the pilot port of the control valve 174. Specifically, when the bucket operation lever 26B is operated in a bucket opening direction, the bucket operation lever 26B applies the pilot pressure in accordance with the amount of the operation to the right pilot port of the control valve 174. When the bucket operation lever 26B is operated in a bucket closing direction, the bucket operation lever 26B applies the pilot pressure in accordance with the amount of the operation to the left pilot port of the control valve 174.

An operation pressure sensor 29B is an example of the operation pressure sensor 29. The operation pressure sensor 29B detects the operation content of the operator to the bucket operation lever 26B in the form of pressure and outputs a detected value to the controller 30.

Proportional valves 31BL and 31BR are examples of the proportional valve 31, and shuttle valves 32BL and 32BR are examples of the shuttle valve 32. The proportional valve 31BL operates in response to a current command output by the controller 30. The proportional valve 31BL then adjusts the pilot pressure generated by hydraulic oil introduced into the left pilot port of the control valve 174 from the pilot pump 15 through the proportional valve 31BL and the shuttle valve 32BL. The proportional valve 31BR operates in response to a current command output by the controller 30. The proportional valve 31BR then adjusts the pilot pressure generated by hydraulic oil introduced into the right pilot port of the control valve 174 from the pilot pump 15 through the proportional valve 31BR and the shuttle valve 32BR. The proportional valves 31BL and 31BR can adjust the pilot pressure so that the control valve 174 can be stopped at a desired valve position.

This configuration enables the controller 30 to supply the hydraulic oil discharged by the pilot pump 15 to the left pilot port of the control valve 174 through the proportional valve 31BL and the shuttle valve 32BL, independently of the bucket closing operation by the operator. That is, the controller 30 can automatically close the bucket 6. The controller 30 can also supply the hydraulic oil discharged by the pilot pump 15 to the right pilot port of the control valve 174 through the proportional valve 31BR and the shuttle valve 32BR, independently of the bucket opening operation by the operator. That is, the controller 30 can automatically open the bucket 6.

A swiveling operation lever 26C in FIG. 4C is an example of the operation device 26 and is used to swivel the upper swiveling body 3. The swiveling operation lever 26C utilizes the hydraulic oil discharged by the pilot pump 15 to apply the pilot pressure corresponding to the operation content to the pilot port of the control valve 173. Specifically, when the swiveling operation lever 26C is operated in a left swivel direction, the swiveling operation lever 26C applies the pilot pressure in accordance with the amount of the operation to the left pilot port of the control valve 173. When the swiveling operation lever 26C is operated in a right swivel direction, the swiveling operation lever 26C applies the pilot pressure in accordance with the amount of the operation to the right pilot port of the control valve 173.

An operation pressure sensor 29C is an example of the operation pressure sensor 29. The operation pressure sensor 29C detects the operation content of the operation to the swiveling operation lever 26C in the form of pressure and outputs a detected value to the controller 30.

Proportional valves 31CL and 31CR are examples of the proportional valve 31, and shuttle valves 32CL and 32CR are examples of the shuttle valve 32. The proportional valve 31CL operates in response to a current command output by the controller 30. The proportional valve 31CL then adjusts the pilot pressure generated by the hydraulic oil introduced into the left pilot port of the control valve 173 from the pilot pump 15 through the proportional valve 31CL and the shuttle valve 32CL. The proportional valve 31CR operates in response to a current command output by the controller 30. The proportional valve 31CR then adjusts the pilot pressure generated by the hydraulic oil introduced into the right pilot port of the control valve 173 from the pilot pump 15 through the proportional valve 31CR and the shuttle valve 32CR. The proportional valves 31CL and 31CR can adjust the pilot pressure so that the control valve 173 can be stopped at a desired valve position.

This configuration enables the controller 30 to supply the hydraulic oil discharged by the pilot pump 15 to the left pilot port of the control valve 173 through the proportional valve 31CL and the shuttle valve 32CL, independently of the left swiveling operation by the operator. That is, the controller 30 can automatically swivel the upper swiveling body 3 to the left. The controller 30 can also supply the hydraulic oil discharged by the pilot pump 15 to the right pilot port of the control valve 173 through the proportional valve 31CR and the shuttle valve 32CR, independently of the right swiveling operation by the operator. That is, the controller 30 can automatically swivel the upper swiveling body 3 to the right.

The shovel 100 may be configured to automatically open and close the arm 5 and to automatically move the lower traveling body 1 forward and backward. In this case, the hydraulic system part related to the operation of the arm cylinder 8, the hydraulic system part related to the operation of the left-side traveling hydraulic motor 1L, and the hydraulic system part related to the operation of the right-side traveling hydraulic motor 1R may be configured in a manner similar to the hydraulic system part related to the operation of the boom cylinder 7.

Figure 5:
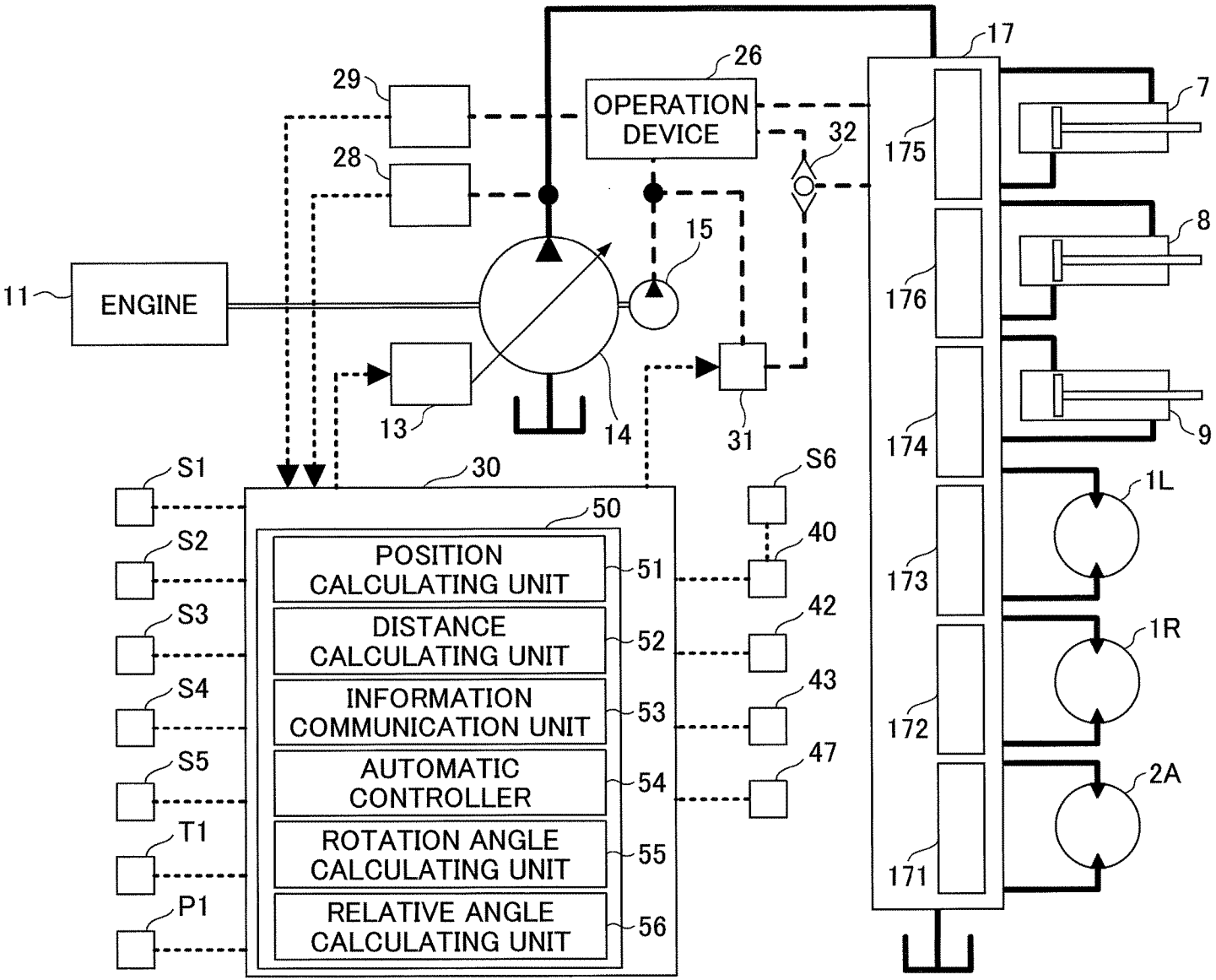
FIG. 5 is a block diagram illustrating another configuration example of a driving system of the shovel of FIG. 1.

Next, another configuration example of the machine guidance device 50 will be described with reference to FIG. 5. FIG. 5 is a block diagram illustrating another configuration example of a driving system of the shovel 100 and corresponds to FIG. 2. The drive system of FIG. 5 differs from the drive system of FIG. 2 in that the machine guidance device 50 includes a rotation angle calculating unit 55 and a relative angle calculating unit 56, but the drive system of FIG. 5 and the drive system of FIG. 2 are common in other points. Thus, the description of the common parts will be omitted, and the different parts will be described in detail.

The rotation angle calculating unit 55 calculates the rotation angle of the upper swiveling body 3. This is to determine the current direction of the upper swiveling body 3. In the present embodiment, the rotation angle calculating unit 55 calculates the angle of the front and rear axis of the upper swiveling body 3 with respect to the reference direction based on an output of the GNSS compass as the positioning device P1, as the rotation angle. The rotation angle calculating unit 55 may calculate the rotation angle based on an output of the swivel angular velocity sensor S5. When the reference point is set in the construction site, the rotation angle calculating unit 55 may use a direction in which the reference point is viewed from a swiveling axis as the reference direction.

The rotation angle indicates a direction in which the attachment operation surface extends. The attachment operation surface is, for example, a virtual plane that crosses the attachment in a longitudinal direction and is positioned perpendicular to a swiveling plane. The swiveling plane is, for example, a virtual plane including a bottom surface of a swiveling frame perpendicular to the swiveling axis. The machine guidance device 50, for example, determines that the upper swiveling body 3 faces the target construction surface straight when the machine guidance device 50 determines that an attachment operation plane AF (see FIG. 8A) includes a normal to the target construction surface.

The relative angle calculating unit 56 calculates the relative angle as the rotation angle necessary to cause the upper swiveling body 3 to face the target construction surface straight. The relative angle is a relative angle formed between a direction of the front and rear axis of the upper swiveling body 3 when the upper swiveling body 3 faces the target construction surface straight and a present direction of the front and rear axis of the upper swiveling body 3, for example. In the present embodiment, the relative angle calculating unit 56 calculates the relative angle based on the information related to the target construction surface stored in the storage device 47 and the rotation angle calculated by the rotation angle calculating unit 55.

When the swiveling operation lever is operated while the predetermined switch is pressed, the automatic controller 54 determines whether the swiveling operation lever is operated in a direction of causing the upper swiveling body 3 to face the target construction surface straight. When the automatic controller 54 determines that the swiveling operation lever is operated in the direction of causing the upper swiveling body 3 to face the target construction surface, the automatic controller 54 sets the relative angle calculated by the relative angle calculating unit 56 as the target angle. When the change of the rotation angle after the rotation operation lever has been operated reaches the target angle, the automatic controller 54 determines that the upper swiveling body 3 faces the target construction surface straight, and stops a movement of the swiveling hydraulic motor 2A.

As described, the machine guidance device 50 of FIG. 5 can cause the upper swiveling body 3 to face the target construction surface straight, in a manner similar to the machine guidance device 50 of FIG. 2.

Figure 6:
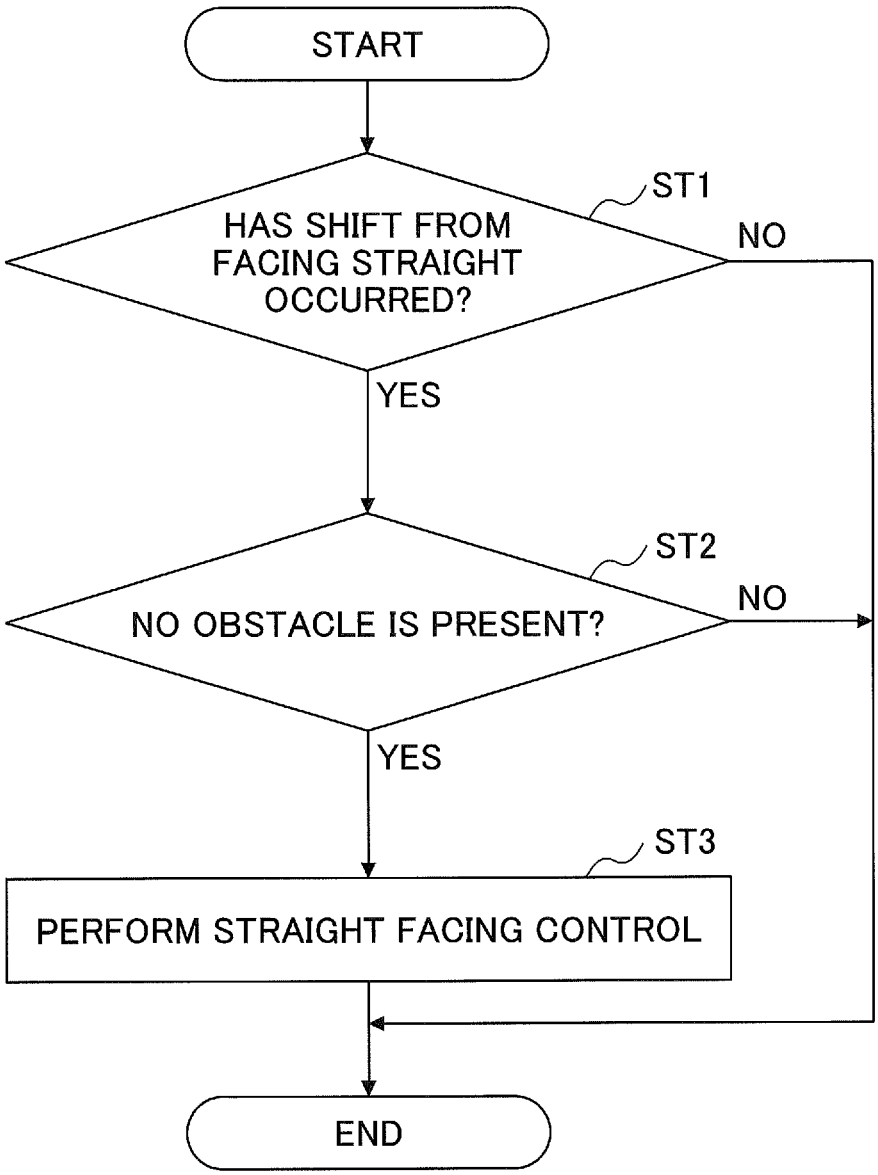
FIG. 6 is a flowchart of a straight facing process.
Figure 7A:
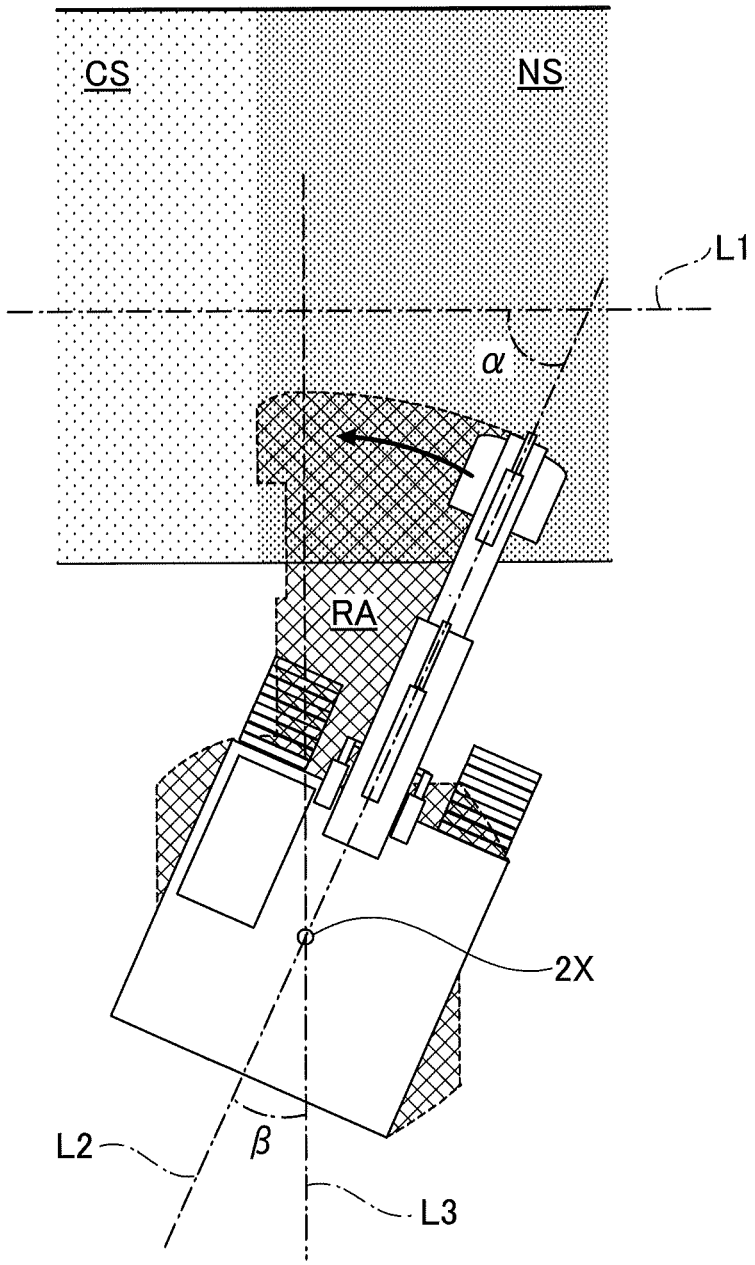
FIG. 7A is a top view of the shovel when the straight facing process is performed.
Figure 7B:
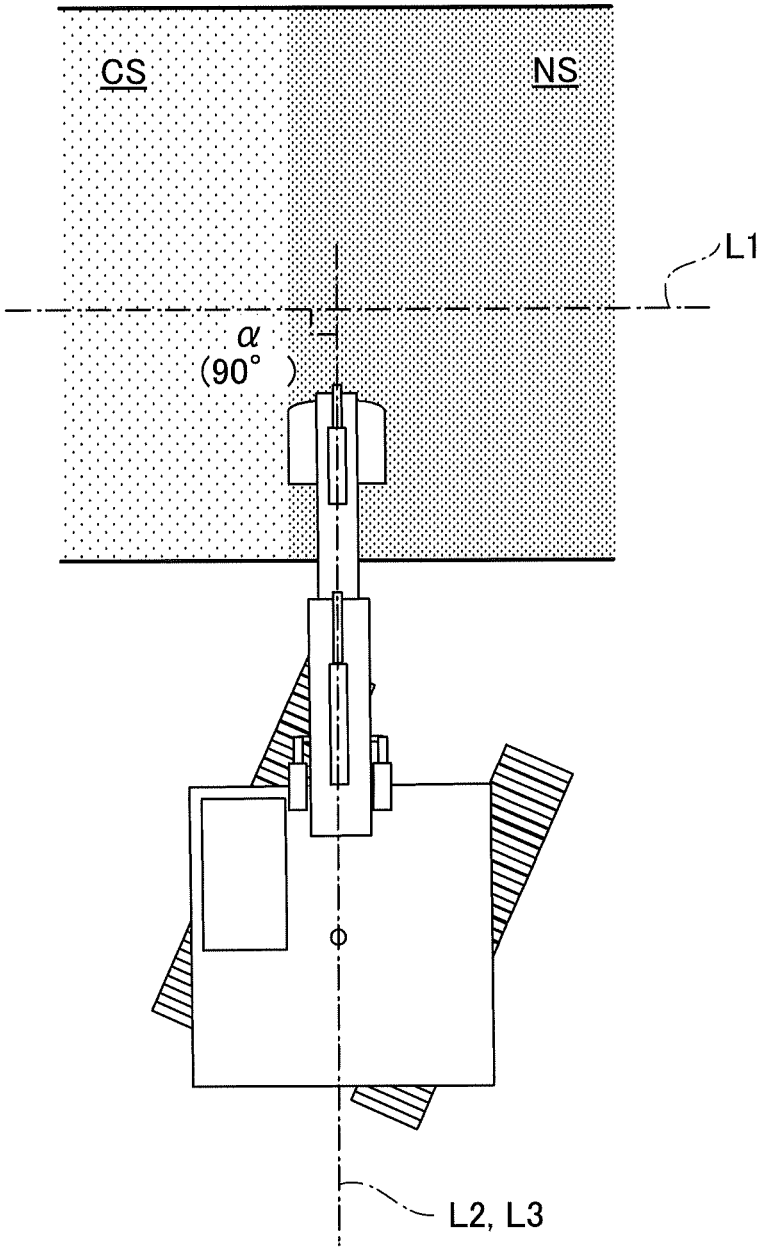
FIG. 7B is a top view of the shovel when the straight facing process is performed.
Figure 8A:
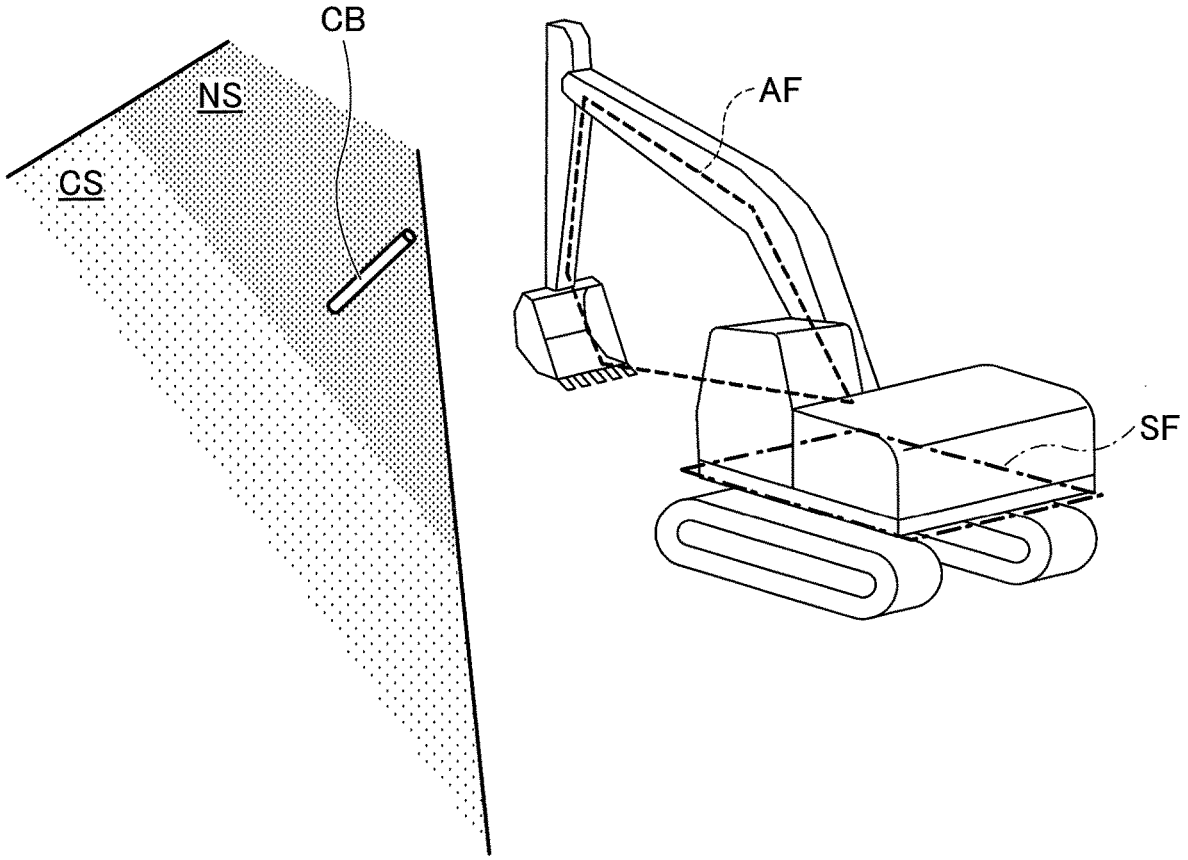
FIG. 8A is a perspective view of the shovel when the straight facing process is performed.
Figure 8B:
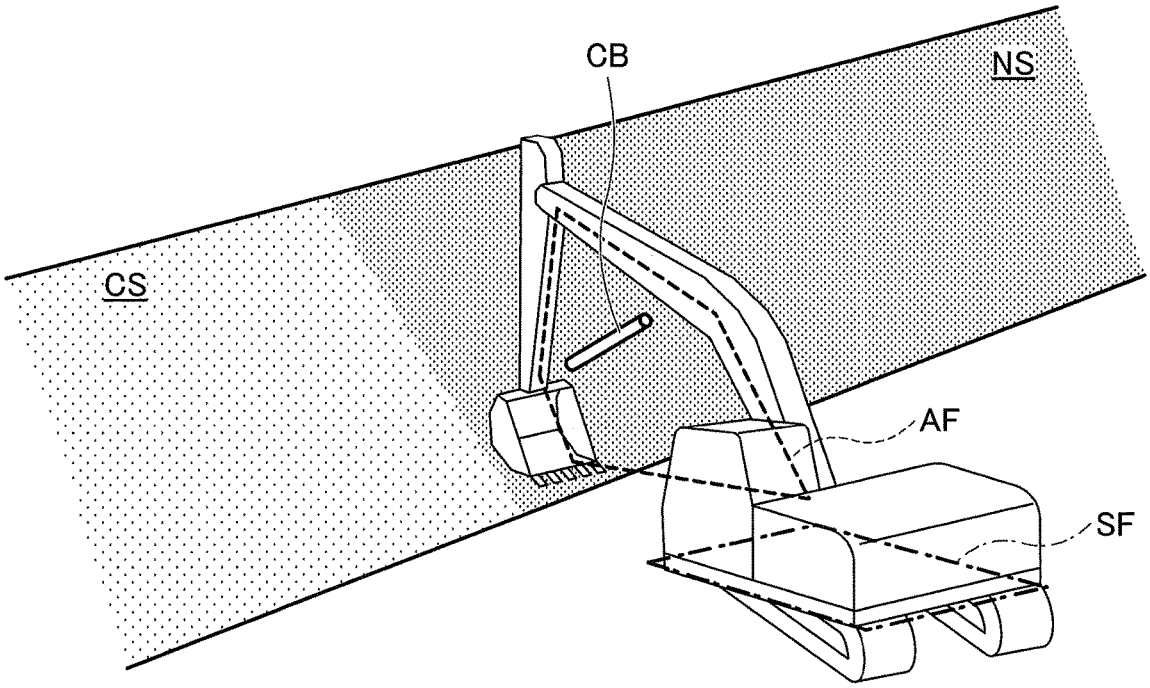
FIG. 8B is a perspective view of the shovel when the straight facing process is performed.

Next, with reference to FIGS. 6, 7A, 7B, 8A, and 8B, an example of a process in which the controller 30 causes the upper swiveling body 3 to face the target construction surface straight (which will be hereinafter referred to as the "straight facing process") will be described. FIG. 6 is a flowchart of the straight facing process. The controller 30 performs the straight facing process when the MC switch is pressed. FIGS. 7A and 7B are top views of the shovel 100 when the straight facing process is performed, and FIGS. 8A and 8B are perspective views of the shovel 100 when the straight facing process is performed, and when the shovel 100 is viewed from the left rear. Specifically, FIGS. 7A and 8A illustrate a state in which the upper swiveling body 3 does not face the target construction surface straight, and FIGS. 7B and 8B illustrate a state in which the upper swiveling body 3 faces the target construction surface straight. In FIGS. 7A, 7B, 8A and 8B, the target construction surface is a backslope BS as illustrated in FIG. 1, for example. A region NS represents a state in which the backslope BS is not completed, that is, a state in which a ground surface ES is not matched with the backslope BS as illustrated in FIG. 1, and a region CS represents a state in which the backslope BS is completed, that is, the ground surface ES is matched with the backslope BS.

The state in which the upper swiveling body 3 faces the target construction surface straight, includes, for example, a state in which an angle $\alpha$ formed between a line segment L1 representing the direction (an extending direction) of the target construction surface and a line segment L2 representing the front and rear axis of the upper swiveling body 3 is 90 degrees on a virtual horizontal plane, as illustrated in FIG. 7B. The extending direction of the slope as the direction of the target construction surface, which is represented by the line segment L1, is a direction orthogonal to a slope length direction, for example. The slope length direction is, for example, a direction along a virtual line segment connecting the top (shoulder) and the bottom (foot) of the slope at the shortest distance. A state in which the upper swiveling body 3 faces the target construction surface straight may be defined as a state in which an angle $\beta$ (see FIG. 9A) formed between the line segment L2 representing the front and rear axis of the upper swiveling body 3 and a line segment L3 perpendicular to the direction (the extending direction) of the target construction surface is 0 degrees on the virtual horizontal plane. A direction represented by the line segment L3 corresponds to a direction of a horizontal component of a perpendicular line drawn to the target construction surface.

A virtual cylinder CB of FIGS. 8A and 8B represents a portion of the normal to the target construction surface (i.e., the backslope BS), a dash-dotted line represents a portion of a virtual swivel plane SF, and a dotted line represents a portion of the virtual attachment operation plane AF. The attachment operation plane AF is arranged to be perpendicular to the swivel plane SF. As illustrated in FIG. 8B, when the upper swiveling body 3 is in a state of facing the target construction surface straight, the attachment operation plane AF is arranged so that the attachment operation plane AF includes the portion of the normal as represented by the virtual cylinder CB, that is, the attachment operation plane AF extends along the portion of the normal.

The automatic controller 54, for example, sets the rotation angle formed when the attachment operation plane AF and the target construction surface (i.e., the backslope BS) are perpendicular to each other, as the target angle. The automatic controller 54 detects the current rotation angle based on the output of the positioning device P1 or the like and calculates a difference between the target angle and the current rotation angle (i.e., a detected value). The automatic controller 54 operates the swiveling hydraulic motor 2A so that the difference is smaller than or equal to a predetermined value or is zero. Specifically, when the difference between the target angle and the current rotation angle is smaller than or equal to the predetermined value or is zero, the automatic controller 54 determines that the upper swiveling body 3 faces the target construction surface straight. When the swiveling operation lever is operated while the predetermined switch is pressed, the automatic controller 54 determines whether the swiveling operation lever is operated in a direction of causing the upper swiveling body 3 to face the target construction surface straight. For example, when the swiveling operation lever is operated in a direction in which the difference between the target angle and the current rotation angle increases, the automatic controller 54 determines that the swiveling operation lever is not operated in a direction of causing the upper swiveling body 3 to face the target construction surface straight, and does not perform the straight facing control. When the swiveling operation lever is operated in a direction in which the difference between the target angle and the current rotation angle decreases, the automatic controller 54 determines that the swiveling operation lever is operated in a direction of causing the upper swiveling body 3 to face the target construction surface straight, and performs the straight facing control. As a result, the swiveling hydraulic motor 2A can be operated so that the difference between the target angle and the current rotation angle decreases. Thereafter, the automatic controller 54 stops the swiveling hydraulic motor 2A when the difference between the target angle and the current rotation angle is smaller than or equal to the predetermined value or is zero.

The example illustrated in FIG. 7B is an example indicating a state in which the attachment operation plane AF includes the normal (i.e., the virtual cylinder CB), and the angle α formed between the line segment L1 representing the direction of the target construction surface and the line segment L2 representing the front and rear axis of the upper swiveling body 3 is 90 degrees. However, as long as the attachment operation plane AF is in a state of including the normal (i.e., the virtual cylinder CB), the angle α is not required to be 90 degrees. For example, since the shovel 100 is often installed on a ground with large relief, even when the attachment operation plane AF is in the state of including the normal (i.e., the virtual cylinder CB), the angle α is not necessarily 90 degrees.

On a basis of the above description of FIGS. 7A, 7B, 8A, and 8B, a flow of the straight facing control will be described with reference to FIG. 6 again. First, the machine guidance device 50 included in the controller 30 determines whether a shift from facing straight has occurred (in step ST1). In the present embodiment, the machine guidance device 50 determines whether a shift from facing straight has occurred based on the information related to the target construction surface previously stored in the storage device 47 and the output of the positioning device P1 as the direction detecting device. The information related to the target construction surface includes information related to the direction of the target construction surface. The positioning device P1 outputs information related to the direction of the upper swiveling body 3. For example, as illustrated in FIG. 8A, in a state in which the attachment operation plane AF does not include the normal to the target construction surface, the machine guidance device 50 determines that a shift from facing the target construction surface straight from the shovel 100 has occurred. In such a state, as illustrated in FIG. 7A, the angle α formed between the line segment L1 representing the direction of the target construction surface and the line segment L2 representing the direction of the upper swiveling body 3 is an angle other than 90 degrees.

Here, the machine guidance device 50 may determine whether a shift from facing straight has occurred based on an image taken by the camera S6. For example, the machine guidance device 50 may, by performing various image processing on the image taken by the camera S6 to derive information related to the shape of the slope to be worked on, determine whether a shift from facing straight has occurred based on the derived information. Alternatively, the machine guidance device 50 may determine whether a shift from facing straight has occurred based on an output of a spatial recognition device other than camera S6, such as ultrasonic sensors, a millimeter wave radar, a distance image sensor, a LIDAR sensor, or an infrared sensor.

When it is determined that a shift from facing straight has not occurred (NO in step ST1), the machine guidance device 50 terminates the current straight facing process without performing the straight facing control.

When it is determined that a shift from facing straight has occurred (YES in step ST1), the machine guidance device 50 determines whether no obstacle is present around the shovel 100 (in step ST2). In the present embodiment, the machine guidance device 50 performs image recognition processing on the image taken by the camera S6 to determine whether an image related to a predetermined obstacle exists in the taken image. The predetermined obstacle is at least one of a person, an animal, a machine, and a building, for example. Then, when it is determined that no image related to the predetermined obstacle exists in an image related to a predetermined area that is set around the shovel 100, it is determined that no obstacle is present around the shovel 100. The predetermined area includes, for example, an area in which there can be an object that comes into contact with the shovel 100 when the shovel 100 is moved to cause the upper swiveling body 3 to face the target construction surface straight. An area RA, which is represented by a cross hatching pattern in FIG. 7A, is an example of the predetermined area. However, the predetermined area may be set as a wider area, such as an area within a predetermined distance from a swiveling axis 2X, for example.

The machine guidance device 50 may determine whether no obstacle is present around the shovel 100 based on an output of a spatial recognition device other than the camera S6, such as an ultrasonic sensor, a millimeter wave radar, a distance image sensor, a LIDAR sensor, or an infrared sensor.

When it is determined that an obstacle is present around the shovel 100 (NO in step ST2), the machine guidance device 50 terminates the current straight facing process without performing the straight facing control. This is to prevent the shovel 100 from contacting the obstacle by performing the straight facing control. In this case, the machine guidance device 50 may output an alarm. The machine guidance device 50 may send information related to the obstacle, such as the presence or absence of the obstacle, the location of the obstacle, and the type of the obstacle, to the external device through the communication device T1. The machine guidance device 50 may receive information related to the obstacle obtained by another shovel through the communication device T1.

When it is determined that no obstacle is present around the shovel 100 (YES in step ST2), the machine guidance device 50 performs the straight facing control (in step ST3). In the examples of FIGS. 7A, 7B, 8A, and 8B, the automatic controller 54 of the machine guidance device 50 outputs a current command to the proportional valve 31CL (see FIG. 4C). The pilot pressure generated by the hydraulic oil passing through the proportional valve 31CL and the shuttle valve 32CL from the pilot pump 15 is applied to the left pilot port of the control valve 173. The control valve 173 receiving the pilot pressure at the left pilot port is displaced in the right direction to cause the hydraulic oil discharged by the main pump 14L to flow into a first port 2A1 of the swiveling hydraulic motor 2A. The control valve 173 causes the hydraulic oil that flows out from a second port 2A2 of the swiveling hydraulic motor 2A to flow out to the hydraulic oil tank. As a result, the swiveling hydraulic motor 2A rotates in a forward direction and swivels the upper swiveling body 3 in the left direction around the swiveling axis 2X as illustrated by the arrow in FIG. 7A. Thereafter, as illustrated in FIG. 7B, the automatic controller 54 stops the output of the current command to the proportional valve 31CL at 90 degrees of the angle α or at 0 degrees of the angle β and reduces the pilot pressure applied to the left pilot port of the control valve 173. The control valve 173 is displaced in the left direction to return to a neutral position, and blocks the flow of the hydraulic oil from the main pump 14L toward the first port 2A1 of the swiveling hydraulic motor 2A. The control valve 173 also blocks the flow of the hydraulic oil from the second port 2A2 of the swiveling hydraulic motor 2A toward the hydraulic oil tank. As a result, the swiveling hydraulic motor 2A stops the rotation in the forward direction and stops swiveling the upper swiveling body 3 in the left direction.

As described above, the shovel 100 according to the embodiment of the present invention includes the lower traveling body 1, the upper swiveling body 3 that is rotatably mounted on the lower traveling body 1, and the controller 30 as a controller that can perform the straight facing control by which the actuator is operated to cause the upper swiveling body 3 to face the target construction surface straight, based on information related to the target construction surface and information related to the direction of the upper swiveling body 3. The target construction surface includes, for example, at least one of a foreslope, a backslope, a horizontal surface, and a vertical surface. The information related to the target construction surface includes, for example, information related to the direction of the target construction surface. The direction of the target construction surface is determined based on at least either an extending direction of the target construction surface or a direction of the horizontal component of the perpendicular line drawn to the target construction surface, for example. This configuration enables the shovel 100 to reduce annoyance felt by the operator of the shovel 100 when causing the shovel 100 to face the target construction surface straight. The operator of the shovel 100 does not need to manually operate the actuator such as the swiveling hydraulic motor 2A in order to cause the upper swiveling body 3 to face the target construction surface straight. Further, the operator of the shovel 100 does not need to check whether the upper swiveling body 3 faces the target construction surface straight by viewing an image, such as a Facing Angle Compass displayed on the display device 40.

The controller 30 may be configured to perform the straight facing control when a predetermined switch is operated. For example, the controller 30 may be configured to perform the straight facing control when the MC switch is operated. In this case, the controller 30 can automatically cause the upper swiveling body 3 to face the target construction surface straight when the MC switch for starting the machine control function is pressed. That is, the controller 30 can perform the straight facing control as part of the machine control function. Thus, the controller 30 can reduce annoyance felt by the operator of the shovel 100 when causing the shovel 100 to face the target construction surface straight in performing the machine control function. As a result, the controller 30 can improve the operational efficiency of the shovel 100.

When the swiveling operation lever 26C is operated while the straight facing control is performed, the controller 30 may stop performing the straight facing control. This is to prioritize manual operation by the operator. This configuration enables the operator to manually operate the actuator through the operation device 26, even when the straight facing control is being performed, that is, even when the actuator is being automatically operated.

Even when the controller 30 determines that a shift from facing straight has occurred in step ST1, the controller 30 may not perform the straight facing control when a shift from facing straight is large. Specifically, the automatic controller 54 may be configured so as not to perform the straight facing control when the angle α at the time when it is determined that a shift from facing straight has occurred, is smaller than a first threshold value, that is, when the angle β is larger than a second threshold value (i.e., a value obtained by subtracting the first threshold value from 90 degrees). This is to prevent the operator from being anxious about too large an operation amount of the shovel 100 performed by automatic control in a state in which the operation device 26 is not operated.

In other words, the controller 30 may be configured to perform the straight facing control only when the angle between the direction of the target construction surface and the direction of the upper swiveling body 3 is within a predetermined angle range. For example, the controller 30 may be configured to perform the straight facing control only when the angle α is larger than or equal to the first threshold and is smaller than or equal to 90 degrees, or only when the angle β is larger than or equal to 0 degrees and is smaller than or equal to the second threshold, as illustrated in FIG. 7A.

The controller 30 may be configured to perform the straight facing control when it is confirmed that no obstacle is present around the upper swiveling body 3. This is to prevent the contact between the upper swiveling body 3 and the obstacle when the straight facing control is being performed.

The preferred embodiment of the present invention has been described in detail above. However, the invention is not limited to the embodiments described above. Various modifications, substitutions, and the like can be applied to the embodiments described above without departing from the scope of the invention. Also, the characteristics described separately may be combined as long as a technical inconsistency is not caused.

For example, in the above-described embodiment, the controller 30 automatically operates the swiveling hydraulic motor 2A to cause the upper swiveling body 3 to face the target construction surface straight. However, the controller 30 may automatically operate the swivel motor generator to cause the upper swiveling body 3 to face the target construction surface straight.

Additionally, the controller 30 may operate another actuator to cause the upper swiveling body 3 to face the target construction surface straight. For example, as illustrated in FIGS. 9A and 9B, the controller 30 may automatically operate the left-side traveling hydraulic motor 1L and the right-side traveling hydraulic motor 1R to cause the upper swiveling body 3 to face the target construction surface straight.

Figure 9A:
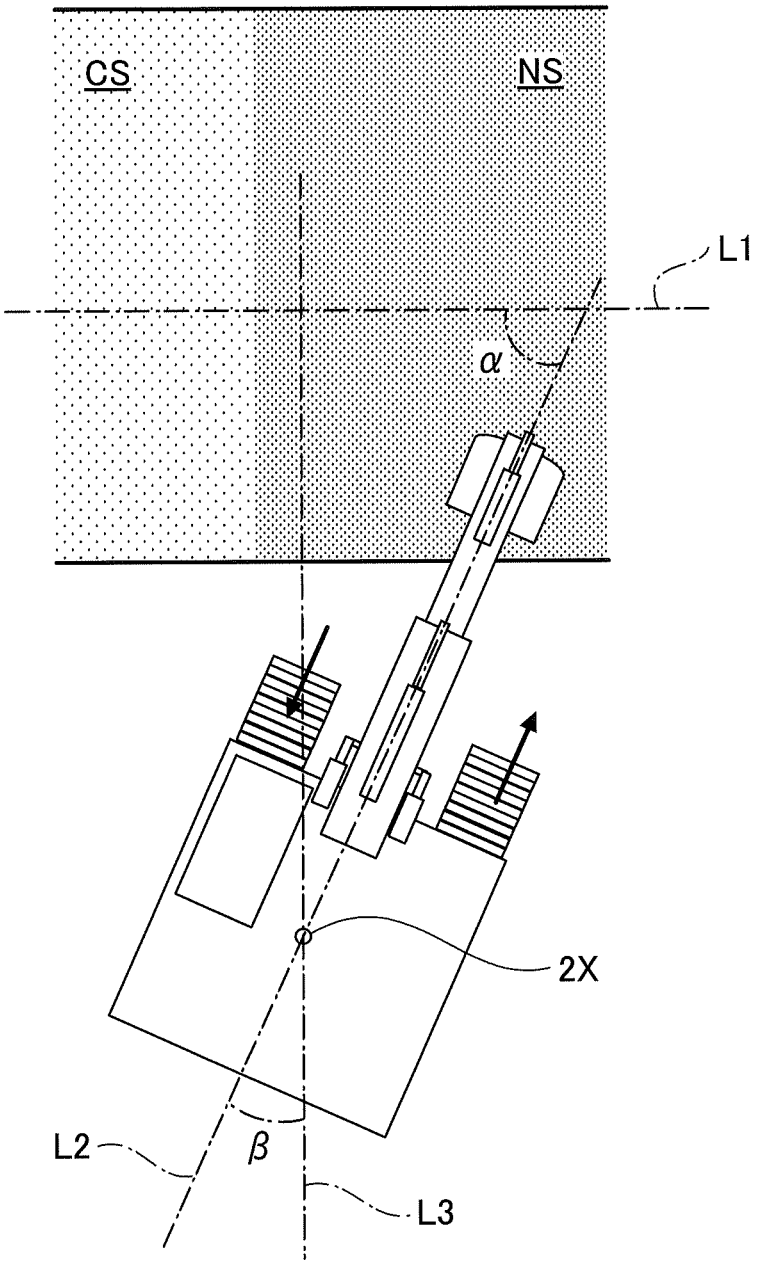
FIG. 9A is a top view of the shovel when the straight facing process is performed.
Figure 9B:
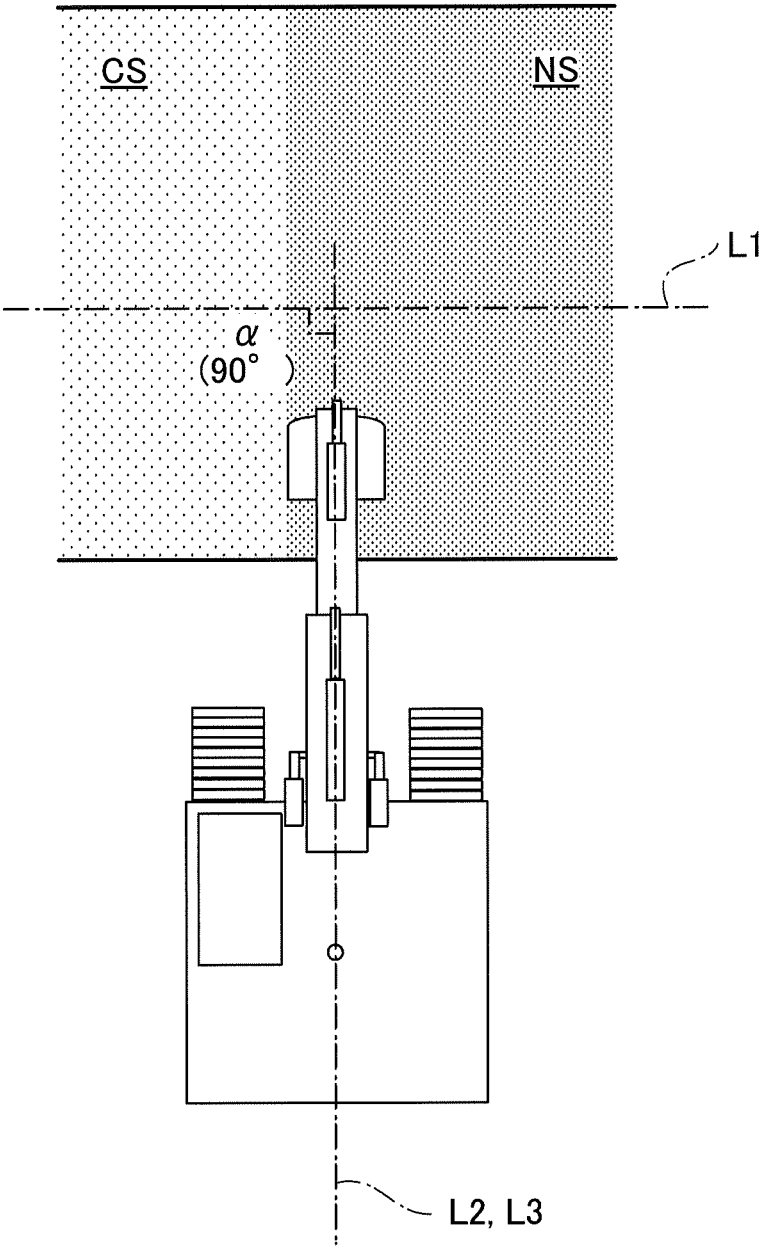
FIG. 9B is a top view of the shovel when the straight facing process is performed.

FIGS. 9A and 9B are top views of the shovel 100 when the straight facing process is performed and correspond to FIGS. 7A and 7B. That is, FIG. 9A illustrates a state in which the upper swiveling body 3 does not face the target construction surface straight, and FIG. 9B illustrates a state in which the upper swiveling body 3 faces the target construction surface straight.

In the examples of FIGS. 9A and 9B, the controller 30 performs a spin turn by rotating the right-side traveling hydraulic motor 1R in a forward direction and rotating the left-side traveling hydraulic motor 1L in a reverse direction to cause the upper swiveling body 3 to face the target construction surface straight.

Figure 10:
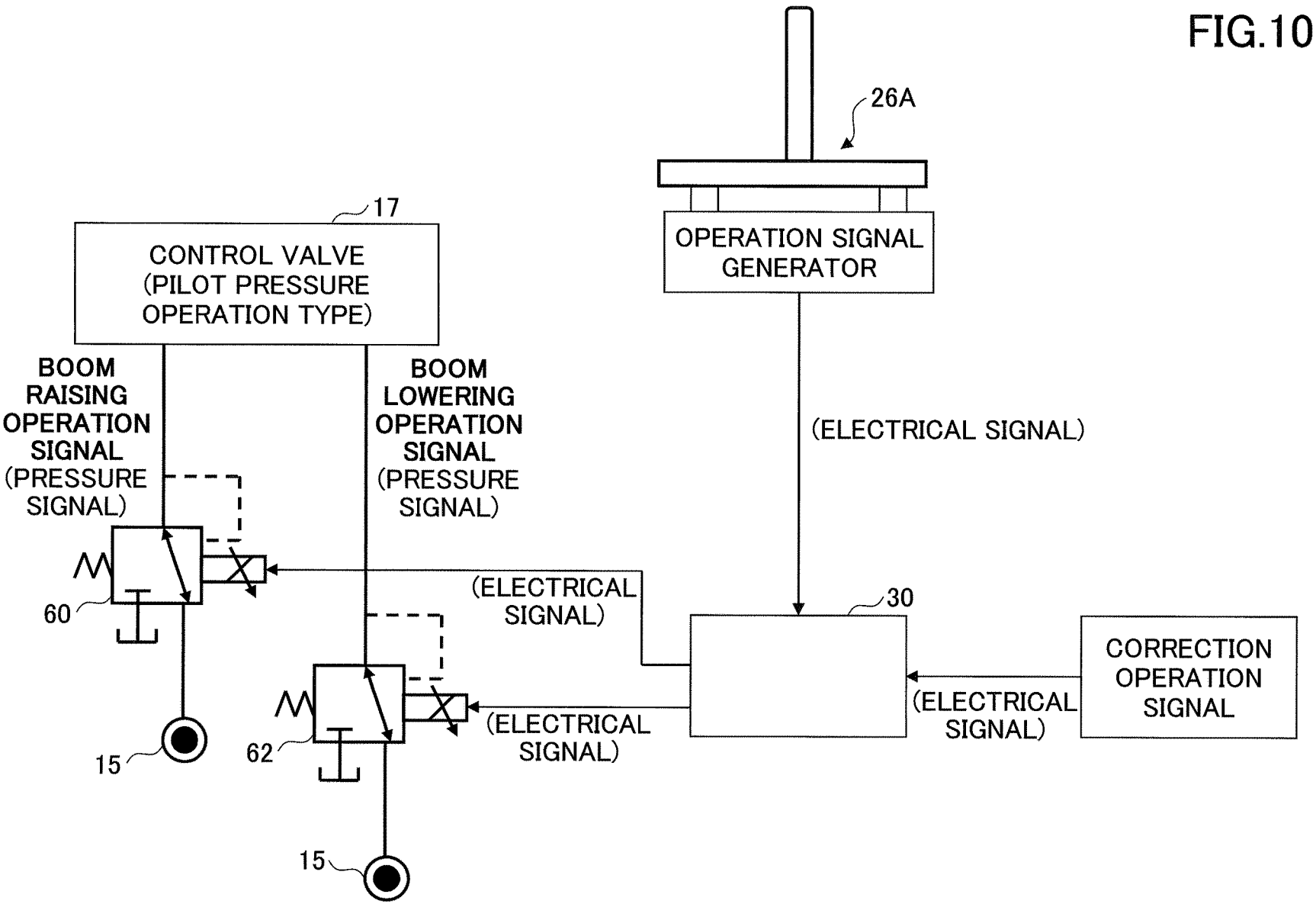
FIG. 10 is a diagram illustrating a configuration example of an operation system including an electric operation device.

In the above-described embodiments, a hydraulic operation device is employed as the operation device 26, but an electric operation device may be employed. FIG. 10 illustrates a configuration example of an operation system including the electric operation device. Specifically, the operation system illustrated in FIG. 10 is an example of a boom operation system. The boom operation system mainly includes the pilot pressure operated control valve 17, the boom operation lever 26A as the electric operation lever, the controller 30, a solenoid valve 60 for a boom raising operation, and a solenoid valve 62 for a boom lowering operation. The operating system of FIG. 10 may also be applied to an arm operation system, a bucket operation system, and the like.

The pilot pressure operated control valve 17 includes the control valves 175L and 175R for the boom cylinder 7, as illustrated in FIG. 3. The solenoid valve 60 is configured to adjust a flow path area of an oil path connecting the pilot pump 15 to the right pilot port of the control valve 175L and connecting the pilot pump 15 to the left pilot port of the control valve 175R. The solenoid valve 62 is configured to adjust a flow path area of an oil path connecting the pilot pump 15 to the right pilot port of the control valve 175R.

When the manual operation is performed, the controller 30 generates a boom raising operation signal (i.e., an electrical signal) or a boom lowering operation signal (i.e., an electrical signal) in response to an operation signal (i.e., an electrical signal) output by the operation signal generator of the boom operation lever 26A. The operation signal output by the operation signal generator of the boom operation lever 26A is an electrical signal that varies in accordance with the operation amount and the operation direction of the boom operation lever 26A.

Specifically, when the boom operation lever 26A is operated in the boom raising direction, the controller 30 outputs the boom raising operation signal (i.e., the electrical signal) in accordance with the amount of the lever operation to the solenoid valve 60. The solenoid valve 60 adjusts the flow path area in accordance with the boom raising operation signal (i.e., the electrical signal) to control the pilot pressure applied to the right pilot port of the control valve 175L and the left pilot port of the control valve 175R. Similarly, when the boom operation lever 26A is operated in the boom lowering direction, the controller 30 outputs the boom lowering operation signal (i.e., the electrical signal) in accordance with the amount of the lever operation to the solenoid valve 62. The solenoid valve 62 adjusts the flow path area in accordance with the boom lowering operation signal (i.e., the electrical signal) to control the pilot pressure applied to the right pilot port of the control valve 175R.

When the automatic control is performed, the controller 30 generates the boom raising operation signal (i.e., the electrical signal) or the boom lowering operation signal (i.e., the electrical signal) in accordance with a correction operation signal (i.e., the electrical signal) instead of the operation signal output by the operation signal generator of the boom operation lever 26A. The correction operation signal may be an electrical signal generated by the machine guidance device 50 or an electrical signal generated by a controller other than the machine guidance device 50.

It should be understood that the invention is not limited to the above-described embodiment, but may be modified into various forms on the basis of the spirit of the invention. Additionally, the modifications are included in the scope of the invention.

What is claimed is:

1. A shovel comprising:

a lower traveling body;

an upper swiveling body that is rotatably mounted on the lower traveling body; and a controller configured to perform straight facing control by which an actuator for swiveling or an actuator for travelling is automatically operated to cause the upper swiveling body to face a target construction surface straight, based on information related to the target construction surface and information related to a direction of the upper swiveling body, wherein the controller automatically operates the actuator for swiveling or the actuator for travelling, based on the information related to the target construction surface and the information related to the direction of the upper swiveling body.

2. The shovel as claimed in claim 1, wherein the controller performs the straight facing control when a predetermined switch is operated.

3. The shovel as claimed in claim 2, wherein the controller stops performing the straight facing control when a swiveling operation lever is operated while the controller performs the straight facing control.

4. The shovel as claimed in claim 1, wherein the controller can perform the straight facing control when an angle between a direction of the target construction surface and the direction of the upper swiveling body is within a predetermined angle range.

5. The shovel as claimed in claim 1, wherein the controller can perform the straight facing control when the controller has confirmed no obstacle is present around the upper swiveling body.

6. The shovel as claimed in claim 1, wherein the controller informs an operator that the controller has caused the upper swiveling body to face the target construction surface straight.

7. The shovel as claimed in claim 1, wherein the controller operates the actuator to maintain a state in which the upper swiveling body faces the target construction surface straight.

8. The shovel as claimed in claim 1, comprising a communication device configured to send construction information to an external device.

9. The shovel as claimed in claim 1, comprising a communication device configured to send and receive information related to an obstacle.

10. A shovel comprising:

a lower traveling body;

an upper swiveling body that is rotatably mounted on the lower traveling body;

an attachment that is attached to the upper swiveling body; and a controller configured to perform straight facing control by which an actuator for swiveling or an actuator for travelling is automatically operated so that an operation plane of the attachment includes a normal to a target construction surface, based on information related to the target construction surface and information related to a direction of the upper swiveling body, the operation plane of the attachment being a virtual plane crossing the attachment in a longitudinal direction, wherein the controller automatically operates the actuator for swiveling or the actuator for travelling, based on the information related to the target construction surface and the information related to the direction of the upper swiveling body.

11. A shovel comprising:

a lower traveling body;

an upper swiveling body that is rotatably mounted on the lower traveling body;

an attachment that is attached to the upper swiveling body; and a controller configured to perform straight facing control by which an actuator is operated so that a difference between a left vertical distance and a right vertical distance is smaller than or equal to a predetermined value, based on information related to a target construction surface and information related to a direction of the upper swiveling body, the left vertical distance being a vertical distance between a left end of a front end of the attachment and the target construction surface, and the right vertical distance being a vertical distance between a right end of the front end of the attachment and the target construction surface.

* * * * *